US009493009B2

(12) United States Patent
Kimura et al.

(10) Patent No.: US 9,493,009 B2
(45) Date of Patent: Nov. 15, 2016

(54) TANK UNIT FOR SUPPLYING LIQUID TO LIQUID JETTING APPARATUS, AND LIQUID JETTING SYSTEM INCLUDING TANK UNIT AND LIQUID JETTING APPARATUS

(71) Applicant: SEIKO EPSON CORPORATION, Tokyo (JP)

(72) Inventors: Naomi Kimura, Nagano (JP); Munehide Kanaya, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 30 days.

(21) Appl. No.: 14/944,784

(22) Filed: Nov. 18, 2015

(65) Prior Publication Data

US 2016/0263906 A1 Sep. 15, 2016

(30) Foreign Application Priority Data

Mar. 12, 2015 (JP) ..... 2015-049557

(51) Int. Cl.
*B41J 2/14* (2006.01)
*B41J 2/16* (2006.01)
*B41J 2/175* (2006.01)

(52) U.S. Cl.
CPC ..... *B41J 2/17526* (2013.01); *B41J 2/17553* (2013.01)

(58) Field of Classification Search
CPC ..... B41J 2/17526; B41J 2/17509; B41J 2/17513; B41J 2/1752; B41J 2/1753; B41J 2/17533; B41J 2/17553
See application file for complete search history.

(56) References Cited

U.S. PATENT DOCUMENTS 5,138,344 A * 8/1992 Ujita ..... B41J 2/17513 347/14

FOREIGN PATENT DOCUMENTS

JP 2012-051327 A 3/2012
JP 2014-184594 A 10/2014

* cited by examiner

*Primary Examiner* — Juanita D Jackson
(74) *Attorney, Agent, or Firm* — Global IP Counselors, LLP

(57) ABSTRACT

Provided is a technique for allowing a test for a tank to be performed in a simple manner. A tank unit 20A has a plurality of ink tanks 25A, a substrate part 80, and a casing part 21A. Each ink tank 25A includes electrode pins 70*a* and 70*b* used for detection of ink IN. The substrate part 80 is connected to back ends 72*a* and 72*b* of the electrode pins 70*a* and 70*b* protruding outside of the ink tanks 25A. The casing part 21A stores the ink tanks 25A and the substrate part 80. Through windows 92 that expose the electrode pins 70*a* and 70*b* to the outside are provided in the back face of the casing part 21A.

15 Claims, 28 Drawing Sheets

TANK UNIT FOR SUPPLYING LIQUID TO LIQUID JETTING APPARATUS, AND LIQUID JETTING SYSTEM INCLUDING TANK UNIT AND LIQUID JETTING APPARATUS

BACKGROUND

1. Technical Field

The present invention relates to a tank unit and a liquid jetting system.

2. Related Art

As one aspect of a liquid jetting system, an inkjet printer for discharging ink droplets and forming an image is known. A tank unit provided with a plurality of ink tanks is coupled to some inkjet printers (for example, JP A-2012-051327). In addition, in some ink tanks, a user can replenish ink, or the presence or absence of ink in the ink tank can be electrically detected (for example, JP A-2014-184594).

In some cases, an electrical conductivity test of a terminal part for electrical connection to the outside, a test regarding ink supply performance, and the like are performed in an ink tank, before factory shipping, at the time of maintenance, or the like. It is desirable that such a test for the ink tank is performed in a tank unit in a simple manner.

SUMMARY

An advantage of some aspects of the invention is to solve at least the above-described problem regarding the tank unit capable of supplying a liquid to a liquid jetting apparatus, and the invention can be realized as the following modes.

[1] According to a first mode of the invention, a tank unit is provided. The tank unit of this mode may be capable of supplying a liquid to a liquid jetting apparatus. The tank unit may include a tank and an exterior part. The tank may have a liquid container and a terminal part. The liquid container may be capable of storing the liquid. The terminal part may be capable of electrically connecting to the outside. The exterior part may be capable of storing the tank, and be capable of being coupled to the liquid jetting apparatus. One or more openings that expose at least a portion of the terminal part in the tank to the outside may be provided in the exterior part. The exterior part may be coupled to the liquid jetting apparatus in a posture in which the one or more openings face the liquid jetting apparatus. According to the tank unit of this mode, a test for the terminal part of the tank can be easily performed via the one or more openings of the exterior part when coupling with the liquid jetting apparatus has been released.

[2] According to a second mode of the invention, a tank unit is provided. The tank unit of this mode may be capable of supplying a liquid to a liquid jetting apparatus. The tank unit may include a tank, an exterior part, and a supporting member. The tank may have a liquid container and a terminal part. The liquid container may be capable of storing a liquid. The terminal part may be capable of electrically connecting to the outside. In the exterior part, the supporting member may be capable of fixing the tank to the exterior part. One or more openings that are positioned between the terminal part and the liquid jetting apparatus when the exterior part is coupled to the liquid jetting apparatus may be provided in the supporting member. At least a portion of the terminal part may be exposed to the outside via the one or more openings of the supporting member when the exterior part is not coupled to the liquid jetting apparatus. According to the tank unit of this mode, when coupling with the liquid jetting apparatus has been released, a test for the terminal part of the tank can be easily performed via the one or more openings of the supporting member.

[3] In the tank unit of the above mode, at least a portion of the terminal part may be positioned in the one or more openings when the one or more openings are viewed in an opening direction. According to the tank unit of this mode, accessing the terminal part via the one or more openings becomes easy, and a test for the terminal part can be performed more easily.

[4] In the tank unit of the above mode, the tank may include an electrode part used for detection of the liquid stored in the liquid container, and the terminal part may be electrically conducted with the electrode part. According to the tank unit of this mode, a test for the electrode used for detection of a liquid can be performed in a simple manner.

[5] In the tank unit of the above mode, the tank may further include an atmospheric air intake part capable of introducing atmospheric air into the liquid container, and the atmospheric air intake part may be exposed to the outside from the one or more openings and be open toward the one or more openings. According to the tank unit of this mode, a test using the atmospheric air intake part can be easily performed.

[6] In the tank unit of the above mode, the tank may further include a liquid injection part capable of injecting the liquid from outside into the liquid container, and at least a portion of the terminal part exposed from the one or more openings and the atmospheric air intake part may be positioned at positions that are above the liquid container and are closer to the liquid jetting apparatus than the liquid injection part when the exterior part is coupled to the liquid jetting apparatus. According to the tank unit of this mode, a test for the terminal part and the atmospheric air intake part becomes easy.

[7] In the tank unit of the above mode, the tank may further include a liquid injection part capable of injecting the liquid from outside to the liquid container, and at least a portion of the terminal part exposed from the one or more openings and the atmospheric air intake part may be positioned at positions that are higher than the liquid injection part and are closer to the liquid jetting apparatus than the liquid injection part when the exterior part is coupled to the liquid jetting apparatus. According to the tank unit of this mode, a liquid that has spilled from the liquid injection part by mistake or the like is restrained from adhering to the terminal part and the atmospheric air intake part.

[8] The tank unit of the above mode may further include a sealing member capable of sealing the one or more openings. According to the tank unit of this mode, adhesion of a foreign material to the terminal part via the one or more openings or the like is restrained, and the ability to protect the terminal part is improved.

[9] In the tank unit of the above mode, the tank may be a first tank that has a first liquid container, which is the liquid container capable of storing a first liquid, and a first terminal part, which is the terminal part, and the tank unit may further include a second tank that has a second liquid container capable of storing a second liquid and a second terminal part capable of electrically connecting to the outside. At least a portion of the second terminal part in the second tank may be exposed to the outside via the one or more openings. According to the tank unit of this mode, a test for the terminal parts of the first tank and the second tank that are stored in the exterior part can be easily performed.

[10] In the tank unit of the above mode, the first tank may include a first atmospheric air intake part capable of introducing atmospheric air into the first liquid container, the second tank may include a second atmospheric air intake part capable of introducing atmospheric air into the second liquid container, and the first atmospheric air intake part and the second atmospheric air intake part may be exposed to the outside from the one or more openings and be open toward the one or more openings. According to the tank unit of this mode, a test using the second atmospheric air intake part of the second tank becomes easy.

[11] In the tank unit of the above mode, the tank may be a first tank that has a first liquid container, which is the liquid container capable of storing a first liquid, and a first terminal part, which is the terminal part, and the tank unit may further include a second tank that has a second liquid container capable of storing a second liquid and a second terminal part capable of electrically connecting to the outside. The one or more openings in the exterior part may include a first opening that exposes at least a portion of the first terminal part to the outside and a second opening that exposes at least a portion of the second terminal part to the outside. According to the tank unit of this mode, a test for the terminal parts of the first tank and the second tank that are stored in the exterior part can be easily performed.

[12] In the tank unit of the above mode, the tank may be a first tank that has a first liquid container, which is the liquid container capable of storing a first liquid, and a first terminal part, which is the terminal part, and the tank unit may further include a second tank that has a second liquid container capable of storing a second liquid and a second terminal part capable of electrically connecting to the outside. The supporting member may fix the first tank and the second tank to the exterior part, and the one or more openings in the supporting member may include a first opening that exposes at least a portion of the first terminal part to the outside and a second opening that exposes at least a portion of the second terminal part to the outside. According to the tank unit of this mode, a test for the terminal parts of the first tank and the second tank can be easily performed.

[13] In the tank unit of the above mode, the first tank may include a first atmospheric air intake part capable of introducing atmospheric air into the first liquid container, the second tank may include a second atmospheric air intake part capable of introducing atmospheric air into the second liquid container, the first atmospheric air intake part may be exposed to the outside from the first opening and be open toward the first opening, and the second atmospheric air intake part may be exposed to the outside from the second opening and be open toward the second opening. According to the tank unit of this mode, a test for the atmospheric air intake parts of the first tank and the second tank becomes easy.

[14] According to a third mode of the invention, a liquid jetting system is provided. This liquid jetting system may include a tank unit, a liquid jetting apparatus, and a tube. The tank unit may be the tank unit of one of the above modes. The liquid jetting apparatus may have a liquid jetting head. The tube may allow the liquid to flow between the tank unit and the liquid jetting head. According to the liquid jetting system of this mode, a test for the terminal part provided in the tank becomes easy.

[15] According to a fourth mode of the invention, a tank unit is provided. This tank unit may be capable of supplying a liquid to a liquid jetting apparatus. The tank unit may include a tank, an exterior part, and a supporting member. The tank may include a liquid container and a terminal part. The liquid container may be capable of storing the liquid. The terminal part may be capable of electrically connecting to the outside. The exterior part may be capable of storing the tank. In the exterior part, the supporting member may fix the tank to the exterior part. The exterior part may include an opening that exposes at least a portion of the supporting member and at least a portion of the tank to the outside. In a section in the supporting member that is exposed from the opening in the exterior part, an opening that exposes at least a portion of the terminal part to the outside may be provided. According to the tank unit of this mode, a test of the terminal part can be performed in a simple manner via the opening of exterior part and the opening of supporting member.

Not all of the constituent components provided in the above-described modes of the invention are essential, and some of the constituent components may be modified, deleted, or replaced with a new constituent component, or the content of limitation may be partially deleted as appropriate, in order to solve a part of or the entire problem described above, or to achieve some or all of the effects described in this specification. It is also possible to combine some or all of the technical features included in one of the above-described modes of the invention with some or all of the technical features included in another one of the above-described modes of the invention to make an independent mode of the invention, in order to solve a part of or the entire problem described above, or to achieve some or all of the effects described in the specification.

The invention can also be achieved in various modes other than the tank unit capable of supplying a liquid to a liquid jetting apparatus or the liquid jetting system. For example, the invention can be achieved as a test method for a tank of a tank unit or a liquid jetting system, or a test apparatus for a tank. In addition, the invention can also be achieved as a test method for a tank unit capable of supplying a liquid to a liquid consumption apparatus that consumes the liquid, other than a liquid jetting apparatus, a liquid consumption system that consumes a liquid, and a tank thereof, as well as a test apparatus for the tank thereof. Note that in this specification, "system" refers to a group of a plurality of constituent elements that are compositely combined in an integral or dispersed state, such that the functions of the constituent elements are related to one another directly or indirectly, in order to achieve one or more functions. Therefore, the system in this specification also includes "apparatus" in which a plurality of constituent elements are integrally combined.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. First Embodiment

Figure 1:
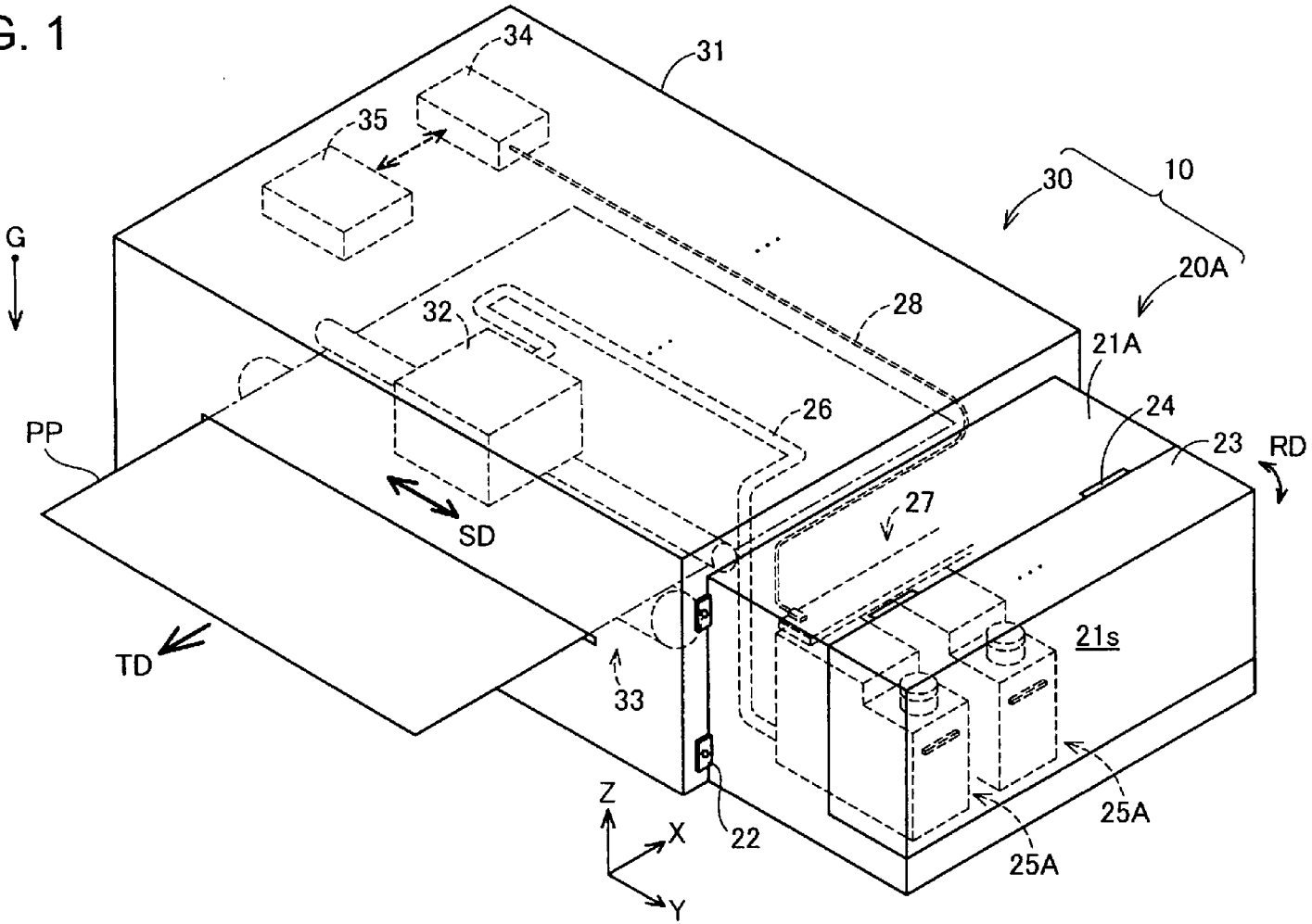
FIG. 1 is a schematic diagram showing a configuration of an inkjet printer in a first embodiment.

FIG. 1 is a schematic diagram showing the configuration of an inkjet printer 10 (hereinafter simply referred to as "printer 10") that is provided with a tank unit 20A in a first embodiment of the invention. In FIG. 1, an arrow G indicating the gravity direction when the printer 10 is in a normal use state is illustrated. In this specification, "upper/upward/above" and "lower/downward/below" mean the up-down direction based on the gravity direction unless especially stated otherwise. In addition, in FIG. 1, arrows X, Y and Z indicating three directions that are based on an ink tank 25 of the tank unit 20A and orthogonally intersect one another are illustrated. The directions indicated by the arrows X, Y and Z will be described later. Arrows G, X, Y and Z are also appropriately illustrated in the drawings referred to in the following description.

The printer 10 is one embodiment of the liquid jetting system in the invention, and forms an image on a printing side of printing paper PP by discharging ink droplets onto the printing paper PP, which is a printing medium. The printer 10 is provided with the tank unit 20A and a printing part 30. The tank unit 20A is one embodiment of the tank unit in the invention. The tank unit 20A includes a plurality of the ink tanks 25A. The tank unit 20A can supply ink stored in the ink tanks 25A to the printing part 30 in a state where the tank unit 20A and the printing part 30 are coupled adjacent to each other in a horizontal direction. The configurations of the tank unit 20A and the ink tank 25A will be described later.

The printing part 30 corresponds to a subordinate concept of the liquid jetting apparatus, and is provided with a casing part 31, a printing head part 32, a conveyance mechanism 33 for the printing paper PP, an ink detection part 34, and a control unit 35. The casing part 31 is an exterior part of the printing part 30, and has the control unit 35, the printing head part 32, and the conveyance mechanism 33 stored therein.

The printing head part 32 is installed so as to be reciprocably movable in a main scanning direction SD on a conveyance path for the printing paper PP. The printing head part 32 is connected to the ink tanks 25A of the tank unit 20A via a plurality of tubes 26 extending from the tank unit 20A and can jet ink supplied from the ink tanks 25A under the control by the control unit 35. The printing head part 32 corresponds to a subordinate concept of the liquid jetting head of the invention. The conveyance mechanism 33 can convey the printing paper PP in a conveyance direction TD intersecting the main scanning direction SD by rotationally driving a conveyance roller.

The ink detection part 34 is electrically connected to the ink tanks 25A of the tank unit 20A via a cable wiring 28 extending from the tank unit 20A. The ink detection part 34 periodically applies a current for detecting ink in the ink tanks 25A to the ink tanks 25A via the cable wiring 28, and detects change in resistance thereof. The ink detection part 34 transmits a detection result to the control unit 35. The electrical connection configuration between the ink detection part 34 and the ink tanks 25A will be described in detail later.

For example, the control unit 35 is constituted by a microcomputer provided with a central processing apparatus and a main storage apparatus. The control unit 35 executes various functions by the central processing apparatus loading various programs to the main storage apparatus and executing the programs. In this embodiment, the control unit 35 functions as a printing processing part for controlling the printing part 30 based on printing data input from outside and executing printing processing. In the printing processing, the conveyance mechanism 33 conveys the printing paper PP, and the printing head part 32 discharges ink droplets while reciprocally moving in the main scanning direction SD, whereby a print image is formed on the printing side of the printing paper PP.

In addition, the control unit 35 also functions as an ink residual amount management part for detecting whether or not ink of a predetermined amount or more is stored in each of the ink tanks 25A based on the change in resistance detected by the ink detection part 34. In the case where an ink deficiency state, that is, a state in which the ink residual amount in the ink tanks 25A became lower than the predetermined amount, is detected, the control unit 35 executes informing processing of informing the user that a replenishment time has come, for example. In addition, the control unit 35 starts measuring the remaining number of times that ink droplets can be discharged by the printing head part 32, and suspends printing processing based on determining that the ink tanks 25A are in an ink shortage state when the remaining number of times is 0.

Figure 2:
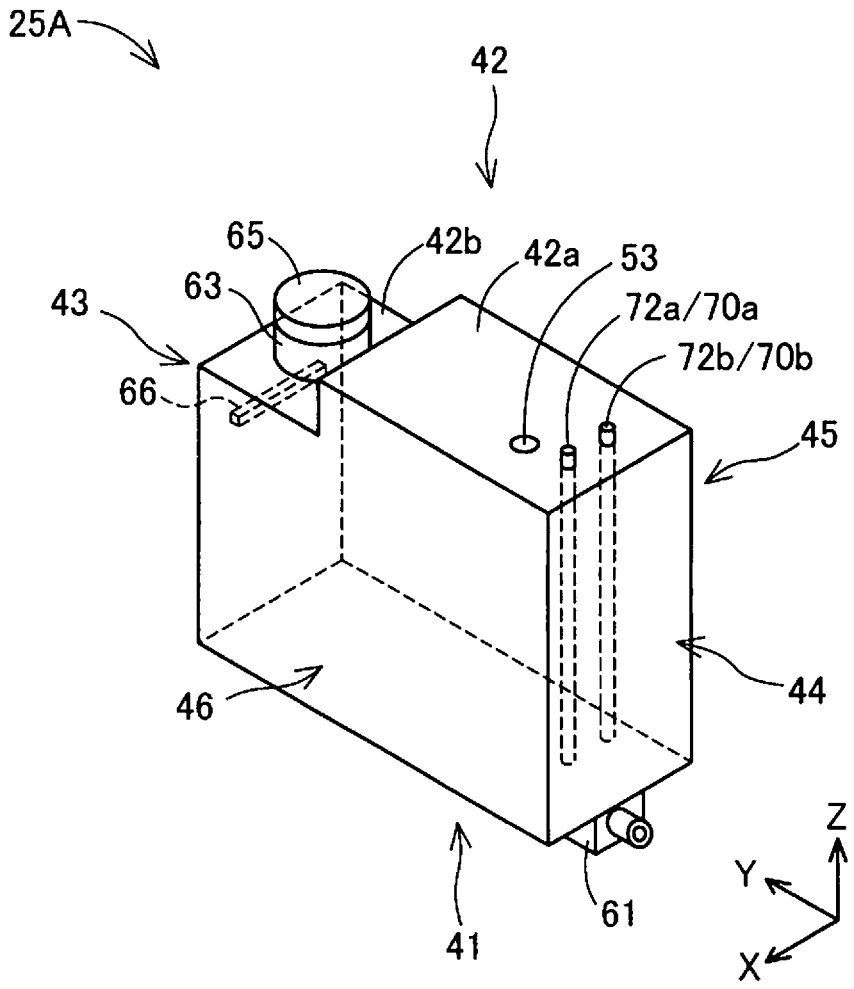
FIG. 2 is a schematic perspective diagram showing an appearance configuration of an ink tank in the first embodiment.
Figure 3:
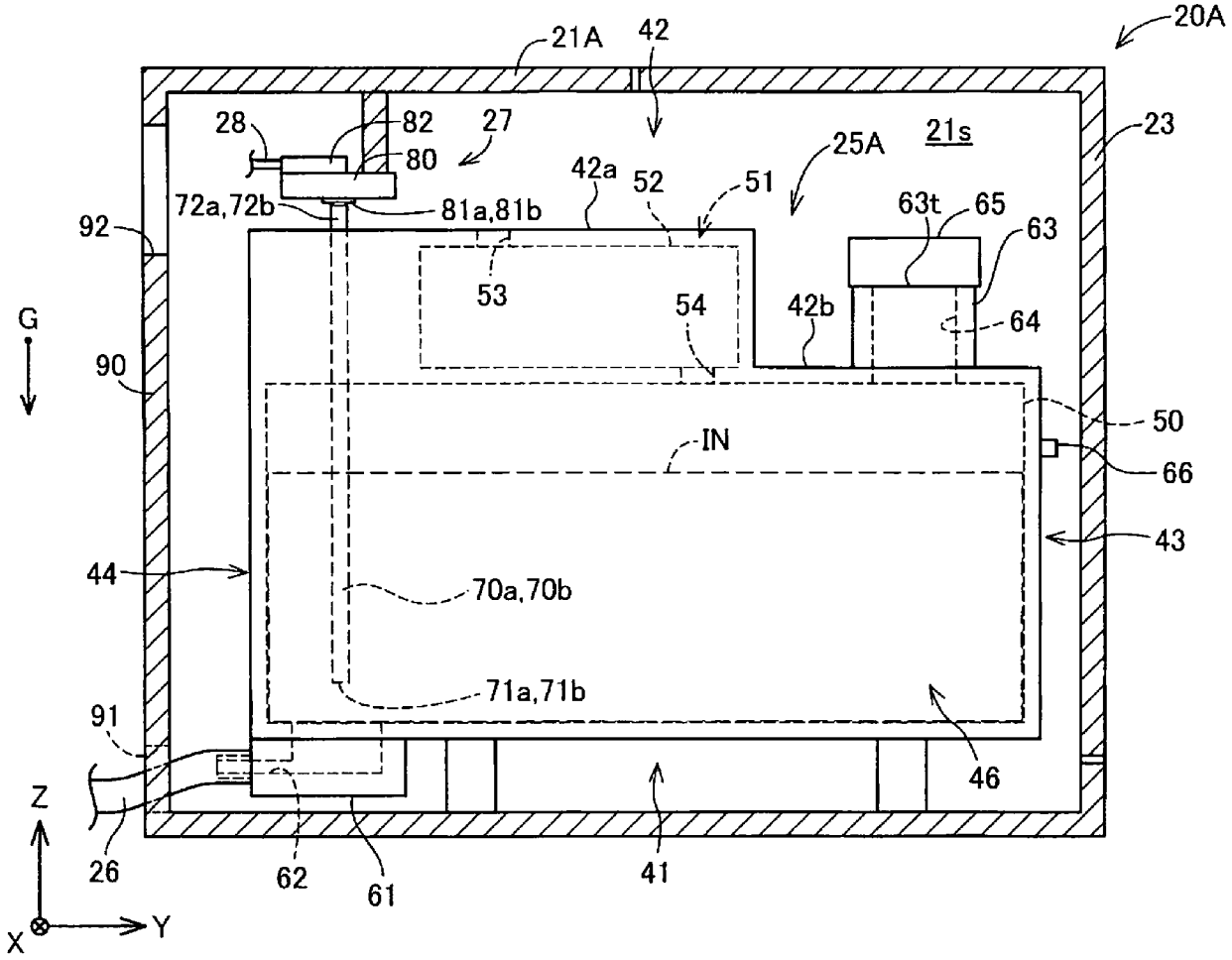
FIG. 3 is a schematic cross-sectional diagram showing an internal configuration of a tank unit in the first embodiment.
Figure 4:
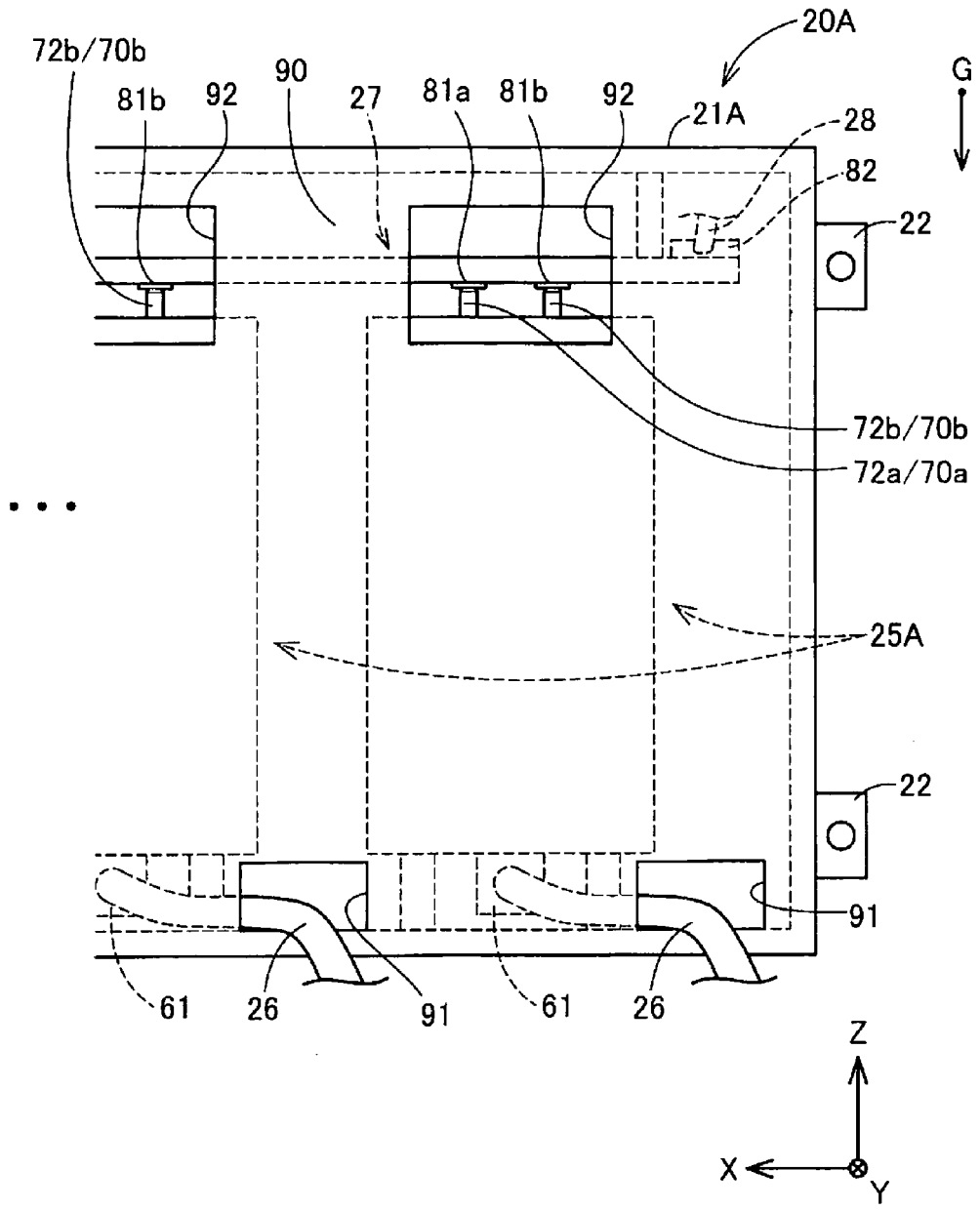
FIG. 4 is a schematic diagram showing a portion of a back face of the tank unit in the first embodiment.

The configurations of the tank unit 20A and the ink tank 25A will be described with reference to FIGS. 2 to 4 in addition to FIG. 1. FIG. 2 is a schematic perspective diagram showing the appearance configuration of the tank unit 20A. FIG. 3 is a schematic cross-sectional diagram showing the internal configuration of the ink tank 25, and is a diagram of the mounted ink tank A when viewed in a direction facing a sixth face part 46 (to be described later). In FIG. 3, portions of the internal configuration of the ink tank 25A are schematically illustrated with broken lines. FIG. 4 is a schematic diagram showing a portion of the back face of the tank unit 20A (to be described later).

The tank unit 20A includes a casing part 21A, a plurality of the ink tanks 25A, a plurality of the tubes 26, a circuit unit 27 and the cable wiring 28 (FIG. 1). The casing part 21A corresponds to a subordinate concept of the exterior part in the invention. In this embodiment, the casing part 21A is constituted as a hollow box body made of resin and having a substantially rectangular parallelepiped shape. In an internal space 21*s* of the casing part 21A, the plurality of ink tanks 25A are fixed in a state of being aligned in a line in a width direction indicated by the arrow X (to be described later).

When the printer 10 is being used, the tank unit 20A is coupled to the printer 10 at a position adjacent to the casing part 31 of the printing part 30 in the horizontal direction via a coupling part 22 provided on the casing part 21A. In this embodiment, the coupling part 22 is constituted as a screw fastening part that is screwed to the casing part 31 of the printing part 30. The coupling part 22 does not need to be constituted as the screw fastening part, and may be constituted by a claw part that engages with a wall part of the casing part 31 of the printing part 30, for example. Note that in this specification, "engage" means catching a predetermined section of an object such that the direction of the movement of the object is restricted.

Here, when performing a normal operation (for example, replenishment of the ink tank 25A with ink) on the tank unit 20A in a used state, a face side that is envisioned to be faced by many users is referred to as "front face side", and a side opposite thereto is referred to as "back face side". For example, it can be interpreted that the side on which the tubes 26 and the cable wiring 28 that are not envisioned to be accessed by a user during normal use are provided is the back face side, and the side opposite thereto is the front face side. In the tank unit 20A of this embodiment, the side facing the printing part 30 in a state where the tank unit 20A is coupled to the printing part 30 is the back face side, and the side facing the side opposite to the printing part 30 side is the front face side. In addition, the side directed in a direction opposite to the direction of the arrow Y (to be described later) when the ink tank 25 is in a reference posture that is described later is the back face side, and the side directed in the direction of the arrow Y is the front face side. In addition, the side positioned on the right side when facing the front face is the right side face, and the side positioned on the left side is the left side face. In this embodiment, in a state in which the tank unit 20A is coupled to the printing part 30, the left side face is directed in a sub scanning direction TD and the right side face is directed in a direction opposite to the sub scanning direction TD (FIG. 1).

In this embodiment, a lid part 23 is provided on the front face side of the casing part 21A (FIGS. 1 to 3). The lid part 23 is coupled to the main body of the casing part 21A using a hinge mechanism 24, and opens and closes by rotating in a direction indicated by an arrow RD. A user of the printer 10 can access the ink tanks 25A stored in the tank unit 20A by opening the lid part 23. Note that the lid part 23 does not need to be constituted to be able to open and close by rotating, and may be constituted to be able to open and close by being attached and detached, for example. Additionally, in this embodiment, a structure for simplifying tests and inspections for the ink tanks 25A is provided on the casing part 21A, and the details thereof will be described later.

Each the plurality of ink tanks 25A stores ink of a different color. The ink tank 25A corresponds to a subordinate concept of the tank in the invention. The ink tank 25A is constituted as a hollow container having six face parts 41 to 46 (FIG. 2). In the tank unit 20A, the ink tanks 25A are fixed in the casing part 21A, in a posture with the face parts 41 to 46 directed in predetermined directions. The six face parts 41 to 46 of the ink tank 25A will be described based on a posture of the ink tank 25A in the tank unit 20A that is coupled to the printing part 30 (FIG. 1). In the following description, this posture will also be referred to as "reference posture". Descriptions regarding the directions of the ink tank 25A and the tank unit 20A in the following description refers to directions during the reference posture unless especially stated otherwise. The same applies in the other embodiments.

A first face part 41 constitutes a bottom face part directed downward, and a second face part 42 constitutes a top face part directed upward (FIG. 2). A third face part 43 is a face intersecting the first face part 41 and the second face part 42 and facing the side opposite to the printing part 30 side, and constitutes a front face part that faces the user when the lid part 23 of the casing part 21A is opened. A fourth face part 44 is a face intersecting the first face part 41 and the second face part 42 and directed in a direction opposite to the third face part 43, and constitutes a back face part that faces the printing part 30. A fifth face part 45 constitutes the left side face part that intersects the four face parts 41 to 44 and is positioned on the left side in the front view of the third face part 43. The sixth face part 46 constitutes the right side face part that intersects the four face parts 41 to 44 and is positioned on the right side, which is opposite to the third face part 43 side in the front view of the third face part 43. In this embodiment, the fifth face part 45 faces the left side face side of the tank unit 20A, and the sixth face part 46 faces the right side face side of the tank unit 20A. Note that in this specification, "two face parts intersect" means one of a state in which two face parts actually intersect each other, a state in which an extension plane of one of the face parts intersects another face part, and a state in which extension planes of two face parts intersect each other.

Next, the arrows X, Y and Z indicating the three directions that are based on the ink tank 25A will be described. The arrow X indicates a direction parallel to the width direction of the ink tank 25A (right-left direction), and indicates a direction from the fifth face part 45 toward the sixth face part 46. In the following description, "right" means a side in the direction of the arrow X, and "left" means a side in a direction opposite to the direction of the arrow X. In this embodiment, the direction of the arrow X is parallel to the arrangement direction of the ink tanks 25A in the tank unit 20A. The arrow Y indicates a direction parallel to the depth direction of the ink tank 25A (front-back direction), and indicates a direction from the fourth face part 44 toward the third face part 43. In the following description, "front" means a side in the direction of the arrow Y, and "back" means a side in a direction opposite to the direction of the arrow Y. In this embodiment, the direction of the arrow Y matches a direction from the back face to the front face of the tank unit 20A. The arrow Z indicates the height direction (up-down direction) of the ink tank 25A, and indicates a direction from the first face part 41 toward the second face part 42. When the ink tank 25A is in the reference posture, the arrow Z is directed in a direction opposite to the gravity direction. In this embodiment, the height direction of the ink tank 25A matches the height direction of the tank unit 20A.

The second face part 42 of the ink tank 25A of this embodiment has a first upper face part 42*a* and the second upper face part 42*b* that are different in height position. The first upper face part 42*a* is at a position higher than the second upper face part 42*b*. In addition, the first upper face part 42*a* is positioned on the fourth face part 44 side, and the second upper face part 42*b* is positioned on the third face part 43 side.

An ink container 50 and an atmospheric air introduction part 51 are formed in the ink tank 25A (FIG. 3). The ink container 50 is a hollow section capable of storing the ink IN, and corresponds to a subordinate concept of the liquid container in the invention. In this embodiment, the ink container 50 is formed over the entirety of the ink tank 25A in the width direction and the front-back direction in the region below the second upper face part 42*b*.

The atmospheric air introduction part 51 functions as an atmospheric air passage for introducing atmospheric air (air) from outside of the ink tank 25A into the ink container 50. The atmospheric air introduction part 51 is formed between the first upper face part 42*a* and the ink container 50. The atmospheric air introduction part 51 has an atmospheric air chamber 52, an atmospheric air intake port 53, and an atmospheric air introduction port 54. The atmospheric air chamber 52 is a hollow section capable of storing atmospheric air taken in from outside. The atmospheric air intake port 53 is a communication port that allows the atmospheric air chamber 52 to communicate with the outside of the ink tank 25A. The atmospheric air introduction port 54 is a communication port that allows the atmospheric air chamber 52 to communicate with the ink container 50. Note that the atmospheric air chamber 52 can also store the ink IN that has spilled from the ink container 50 via the atmospheric air introduction port 54.

An ink supply part 61 is formed on the first face part 41 of the ink tank 25A (FIGS. 2 and 3). The ink supply part 61 is a section that enables the ink IN of the ink container 50 to flow to the outside, and has a through hole 62 that communicates with the lower end of the ink container 50. The ink supply part 61 corresponds to a subordinate concept of a liquid supply part. In this embodiment, the ink supply part 61 is positioned on the fourth face part 44 side, and is open so as to allow the ink IN to flow out in a direction opposite to the direction of the arrow Y. The tube 26 having flexibility and made of resin is connected to the ink supply part 61 in an airtight manner from the back (FIG. 3). The ink IN stored in the ink tanks 25A is supplied to the printing head part 32 of the printing part 30 via the tubes 26 connected to the ink tanks 25A one by one. Note that the ink supply part 61 may have another configuration, and may have a configuration in which the ink supply part 61 is open in the direction of the arrow Z and the tube 26 is mounted from above, for example.

In this embodiment, a plurality of through holes 91 for allowing the tubes 26 to extend to the outside of the casing part 21A are provided at the lower end of a wall part 90 on the back face side in the casing part 21A of the tank unit 20A (hereinafter, also simply referred to as "back face wall part 90") (FIG. 4). Note that the through holes 91 may be provided in a region other than the lower end of the back face wall part 90. In addition, the through holes 91 do not need to be provided in the back face wall part 90, and may be provided in the wall part on the right side face side or the left side face side of the casing part 21A, for example.

An ink injection part 63 is provided on the second upper face part 42*b* of the ink tank 25A (FIGS. 2 and 3). The ink injection part 63 is a section that allows the ink container 50 to communicate with the outside such that the ink IN can be injected into the ink container 50. The ink injection part 63 corresponds to a subordinate concept of the liquid injection part in the invention. In this embodiment, the ink injection part 63 is constituted as a cylindrical section having a through hole 64 that communicates with the ink container 50, and protrudes upward from the second upper face part 42*b*.

Usually, a cap member 65 capable of sealing the through hole 64 is attached to an upper end 63*t* of the ink injecting part 63 in an airtight manner (FIG. 3). The cap member 65 is made of synthetic resin such as nylon or polypropylene. A user can replenish the ink container 50 with the ink IN by removing the cap member 65 from the ink injecting part 63. Note that in this embodiment, the ink injecting part 63 is formed on the third face part 43 side, and therefore the user can access the ink injecting part 63 by opening the lid part 23 of the tank unit 20A.

In the ink tank 25A of this embodiment, a part of or the entire wall part constituting at least the third face part 43 is constituted so as to be transparent or translucent such that a user can visually recognize the liquid surface of the ink IN in the ink container 50 (FIG. 3). Thereby, the user can visually recognize the amount of ink stored in the ink tank 25A when replenishing the ink tank 25A with the ink IN or the like.

A mark part 66 is provided in the wall face of the third face part 43. The mark part 66 is formed so as to indicate the position of the liquid surface of the ink IN when the ink IN of a predetermined reference amount is stored in the ink tank 25A that is in the reference posture. In the ink tank 25A, the maximum amount (reference amount) of the ink IN to be stored in the ink tank 25A is specified by the indication of the mark part 66. The mark part 66 may be formed as a projection or a recess in the wall face part of the third face part 43, and may be formed by printing or attaching a sticker, for example. Note that the entirety of the third face part 43 may be constituted so as to be opaque, and the mark part 66 may be omitted.

In the ink tank 25A of this embodiment, a pair of electrode pins 70*a* and 70*b* are attached to the first upper face part 42*a* on the fourth face part 44 side (FIGS. 2 and 3). The pair of electrode pins 70*a* and 70*b* correspond to a subordinate concept of the electrode part in the invention, and is used for detecting the ink IN stored in the ink container 50. A first electrode pin 70*a* and a second electrode pin 70*b* are constituted by a conductive member extending in a bar-like shape such as a metal pin. The electrode pins 70*a* and 70*b* are desirably constituted by a member on the surface of which generation of an oxidized film due to ink adhesion is restrained. The electrode pins 70*a* and 70*b* may be made of stainless steel, for example.

The electrode pins 70*a* and 70*b* are inserted into the ink container 50 from through holes provided in the second upper face part 42*b* so as to extend toward the bottom face of the ink container 50. Tip ends 71*a* and 71*b*, which are the lower ends of the electrode pins 70*a* and 70*b*, are positioned at a height of the liquid surface of the ink IN in the ink container 50 in an ink sufficiency state (FIG. 3). Back ends 72*a* and 72*b*, which are upper ends of the electrode pins 70*a* and 70*b*, protrude upward from the second upper face part 42*b* so as to enable electrical connection from outside (FIGS. 2 and 3). The back ends 72*a* and 72*b* of the electrode pins 70*a* and 70*b* correspond to a subordinate concept of the terminal part in the invention.

In the tank unit 20A of this embodiment, the common circuit unit 27 is connected to the back ends 72*a* and 72*b* of the electrode pins 70*a* and 70*b* in the ink tanks 25A (FIG. 1). The circuit unit 27 has a substrate part 80 and a cable connection part 82 (FIG. 3). The substrate part 80 may be constituted by a printed substrate having a substantially rectangular shape, for example. The substrate part 80 may be constituted by a flexible printed substrate having flexibility. The substrate part 80 is installed above the ink tanks 25A substantially horizontally with the direction of the arrow X serving as a direction along a long side.

A plurality of pairs of substrate terminals 81*a* and 81*b* that are provided in correspondence with the pair of electrode pins 70*a* and 70*b* of each of the ink tanks 25A are arranged on the face of the lower side of the substrate part 80 in the direction of the arrow X (FIG. 4). A first substrate terminal 81*a* comes into electrical contact with the back end 72*a* of the first electrode pin 70*a*. A second substrate terminal 81*b* comes into electrical contact with the back end 72*b* of the second electrode pin 70*b*.

The cable connection part 82 is fixed to the end of the substrate part 80 (FIG. 4). Conduction paths for the substrate terminals 81*a* and 81*b* are concentratedly arranged on the cable connection part 82 via a wiring pattern (not illustrated) formed on the substrate part 80. The cable connection part 82 is connected to the cable wiring 28 of the tank unit 20A. The cable wiring 28 extends from the casing part 21A via a through hole (not illustrated) provided in a wall part of the casing part 21A, and is connected to the ink detection part 34 of the printing part 30. Accordingly, the ink tanks 25A are electrically connected to the ink detection part 34 of the printing part 30.

When printing processing is being executed or printing processing has been suspended, the ink detection part 34 periodically applies a current to the first electrode pin 70*a*, and detects resistance between the first electrode pin 70*a* and the second electrode pin 70*b*. The resistance between the two electrode pins 70*a* and 70*b* increases when the ink IN in the ink container 50 is consumed and the liquid surface thereof descends to a position that is lower than the top ends 70*a* and 70*b* of the electrode pins 70*a* and 70*b*, and an electrical continuity between the ink IN and the electrode pins 70*a* and 70*b* is shut off. When the resistance detected by the ink detection part 34 increases to a predetermined threshold or more, the control unit 35 detects the ink deficiency state. Note that the control unit 35 may detect, as change in the ink amount of the ink container 50, change in resistance that is in accordance with change in the contact area of the electrode pins 70*a* and 70*b* with the ink IN.

In the tank unit 20A of this embodiment, the ink injection part 63 is positioned on the third face part 43 side, and the back ends 72*a* and 72*b* of the electrode pins 70*a* and 70*b* are positioned on the fourth face part 44 side. Both are formed to be spaced apart in the front-back direction in this manner, and therefore ink droplets are restrained from flying and adhering to the back ends 72*a* and 72*b* of the electrode pins 70*a* and 70*b* when the ink IN is replenished via the ink injection part 63. In addition, in the tank unit 20A of this embodiment, the back ends 72*a* and 72*b* of the electrode pins 70*a* and 70*b* are positioned at positions higher than the upper end 63*t* of the ink injection part 63. Therefore, ink droplets from the ink injection part 63 are further restrained from reaching the back ends 72*a* and 72*b* of the electrode pins 70*a* and 70*b*.

Here, in the tank unit 20A of this embodiment, a plurality of through windows 92 that have a substantially rectangular opening shape are provided in the back face wall part 90 of the casing part 21A (FIG. 4). The through windows 92 are provided in one-to one correspondence with the ink tanks 25A. The through windows 92 are provided so as to be able to expose the back ends 72*a* and 72*b* of the electrode pins 70*a* and 70*b* in the ink tanks 25A to the outside of the casing part 21A. In this specification, "expose to the outside" means causing a target object to be in a state in which direct visual recognition from outside is possible and direct and indirect contact from outside is possible. In addition, a configuration of "being provided so as to be able to be exposed to the outside" includes not only a configuration in which a target object is always exposed to the outside but also a configuration in which a target object is temporarily not exposed to the outside. That is, for example as indicated in the sixth embodiment described later, a configuration in which the through windows 92 are temporarily sealed by a sealing member or the like is included.

In this embodiment, the plurality of through windows 92 are provided such that the back ends 72*a* and 72*b* of the electrode pins 70*a* and 70*b* in each of the ink tanks 25A are positioned in the through windows 92 when viewed in the opening direction thereof. In this embodiment, the opening direction of the through windows 92 is a direction facing the back face wall part 90 and the fourth face part 44 of the ink tank 25A, and is a direction parallel to the arrow Y. In this embodiment, the openings formed in the casing part 21A by providing the plurality of through windows 92 correspond to a subordinate concept of the opening in the invention. Note that the opening shape of the through window 92 does not need to have a substantially rectangular shape, and may have various shapes such as a circular shape.

According to the tank unit 20A of this embodiment, an electrical conductivity tests for the electrode pins 70*a* and 70*b* of each of the ink tanks 25A can be performed in a simple manner via the through windows 92, while the circuit unit 27 is connected in the tank unit 20A. A method of the electrical conductivity test for the electrode pins 70*a* and 70*b* will be described later. In addition, according to the tank unit 20A of this embodiment, a connection state between the back ends 72*a* and 72*b* of the electrode pins 70*a* and 70*b* and the substrate terminals 81*a* and 81*b* of the substrate part 80 can be visually recognized via the through windows 92.

Additionally, in the tank unit 20A of this embodiment, the back face wall part 90 of the tank unit 20A faces the wall face of the casing part 31 of the printing part 30 when the printer 10 is in a normal use state, and the through windows 92 is brought into a blocked state (FIG. 1). Therefore, intrusion of a foreign material such as dust or ink mist in a connection section between the ink tanks 25A and the circuit unit 27 via the through windows 92 is restrained. In addition, a user touching the connection section between the ink tanks 25A and the circuit unit 27 by mistake is restrained.

Figure 5:
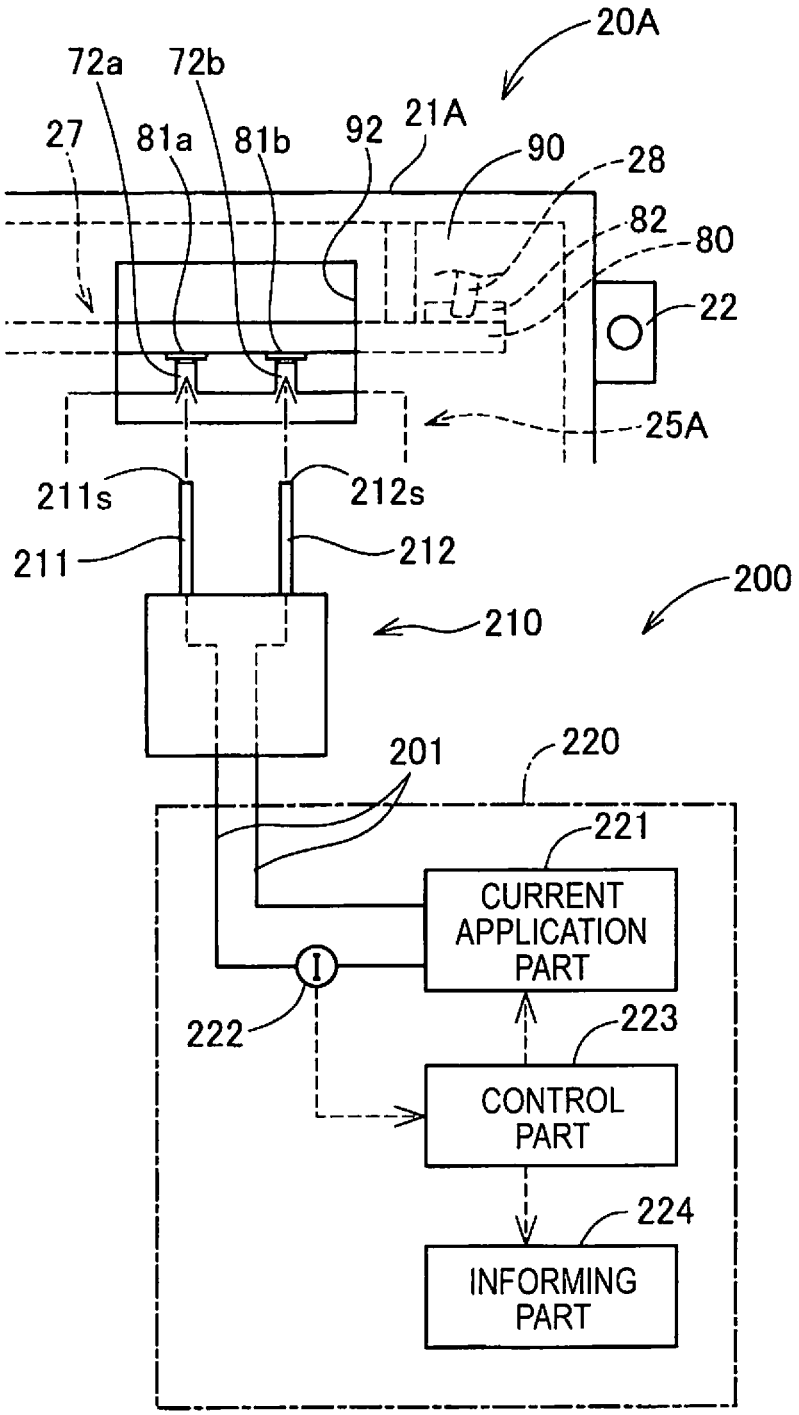
FIG. 5 is a schematic diagram showing a configuration of a test apparatus in the first embodiment.
Figure 6:
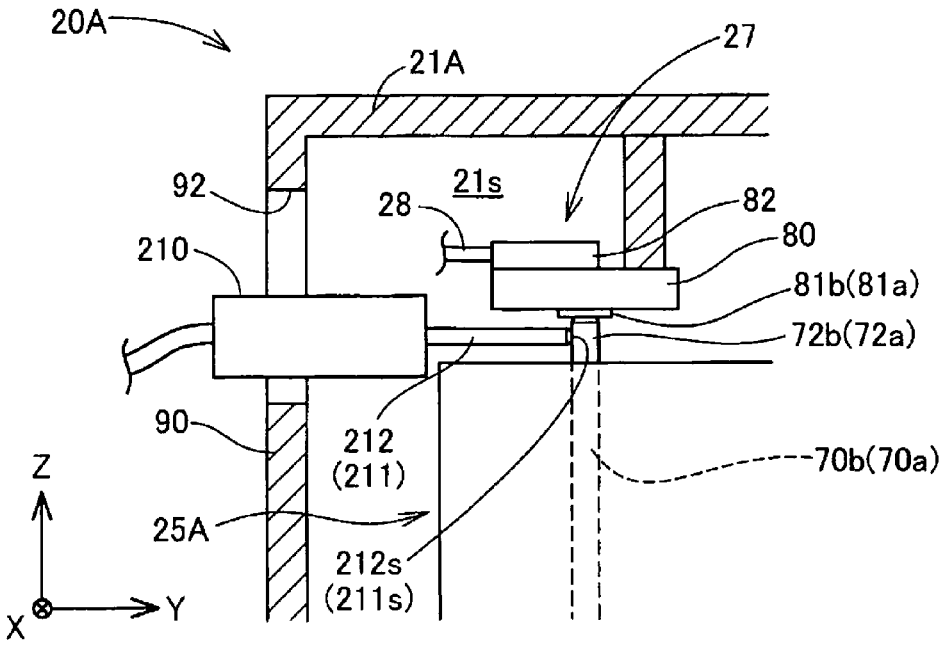
FIG. 6 is a schematic diagram showing a state in which a test is being performed by the test apparatus of the first embodiment.

An example of the method of the electrical conductivity test for the electrode pins 70*a* and 70*b* of each of the ink tanks 25A will be described with reference to FIGS. 5 and 6. FIG. 5 is a schematic diagram showing the configuration of a test apparatus 200 that is used for the test. In FIG. 5, a section in the tank unit 20A that is near the through windows 92 is also illustrated. FIG. 6 is a schematic diagram showing a state when a test is being performed using the test apparatus 200. In FIG. 6, the connection section between the circuit unit 27 and the ink tanks 25A when viewed in the direction of the arrow X is illustrated.

The test apparatus 200 includes a connecter part 210 and a body part 220 (FIG. 5). The connecter part 210 is a section that is electrically connected to the side faces of the back ends 72*a* and 72*b* of the pair of electrode pins 70*a* and 70*b* of the ink tank 25A that is to be tested. The connecter part 210 has a size that allows insertion into the tank unit 20A via the through windows 92.

The connecter part 210 includes a pair of pin terminals 211 and 212. Each of the pin terminals 211 and 212 is constituted by a metal pin having electrical conductivity. The pin terminals 211 and 212 are arranged so as to protrude in parallel at the tip end of the connecter part 210. The lengths of the pin terminals 211 and 212 are substantially the same, and the distance between the pin terminals 211 and 212 is substantially the same as the distance between the pair of electrode pins 70*a* and 70*b*.

When the connecter part 210 is horizontally inserted into the tank unit 20A via the through windows 92, top ends 211*s* and 212*s* of the pin terminals 211 and 212 can come into contact with the side faces of the back ends 72*a* and 72*b* of the electrode pins 70*a* and 70*b* (FIG. 6). A top end 211*s* of the first pin terminal 211 comes into contact with the back end 72*a* of the first electrode pin 70*a*, and a top end 212*s* of the second pin terminal 212 comes into contact with the back end 72*b* of the second electrode pin 70*b*.

The body part 220 of the test apparatus 200 includes a conductive wire 201, a current application part 221, a current measuring part 222, a control part 223, and an informing part 224 (FIG. 5). The current application part 221 is electrically connected to the pin terminals 211 and 212 of the connecter part 210 via the conductive wire 201. The current application part 221 has a power supply part (not illustrated), and can apply a predetermined current to the pin terminals 211 and 212 via the conductive wire 201. The current measuring part 222 is connected to the conductive wire 201 such that the current applied by the current application part 221 can be measured.

The control part 223 is constituted by a microcomputer provided with a central processing apparatus and a main storage apparatus. The control part 223 controls application of a current to the pin terminals 211 and 212 by the current application part 221 in accordance with a switch (not illustrated) operation by a user. The control part 223 receives a signal indicating a measurement result from the current measuring part 222, and outputs the measurement result to the informing part 224. The informing part 224 is constituted by display part such as a liquid crystal display, and informs the user of the measurement result received from the control part 223.

During the test, the tank unit 20A is first removed from the casing part 31 of the printing part 30. At this time, ink is stored in the ink tanks 25A. In addition, the cable wiring 28 is desirably removed from the cable connection part 82 of the circuit unit 27. Next, the connecter part 210 of the test apparatus 200 is inserted into the casing part 21A from the through window 92 in the back face wall part 90 of the tank unit 20A. The pin terminals 211 and 212 of the connecter part 210 are then connected to the back ends 72*a* and 72*b* of the electrode pins 70*a* and 70*b* in the ink tank 25A.

In this state, when a switch operation is performed by the user, the control part 223 applies a current to the pin terminals 211 and 212 using the current application part 221. The control part 223 informs the user of a measurement result obtained by the current measuring part 222 via the informing part 224. In a case where an abnormal current value that is out of a predetermined range is detected by the current measuring part 222, or in the case where a current non-conductive state or the like is detected, the control part 223 informs the user of such a state via the informing part 224. In this manner, the electrical conductivity test for the electrode pins 70*a* and 70*b* of the ink tank 25A can be performed in a simpler manner by using the test apparatus 200.

As described above, according to the printer 10 and the tank unit 20A of this embodiment, the electrical conductivity test for the ink tanks 25A can be executed in a simple manner while the ink tanks 25A are mounted to the tank unit 20A. Additionally, it is possible to exhibit various actions and effects similar to those described in the above embodiment.

B. Second Embodiment

Figure 7:
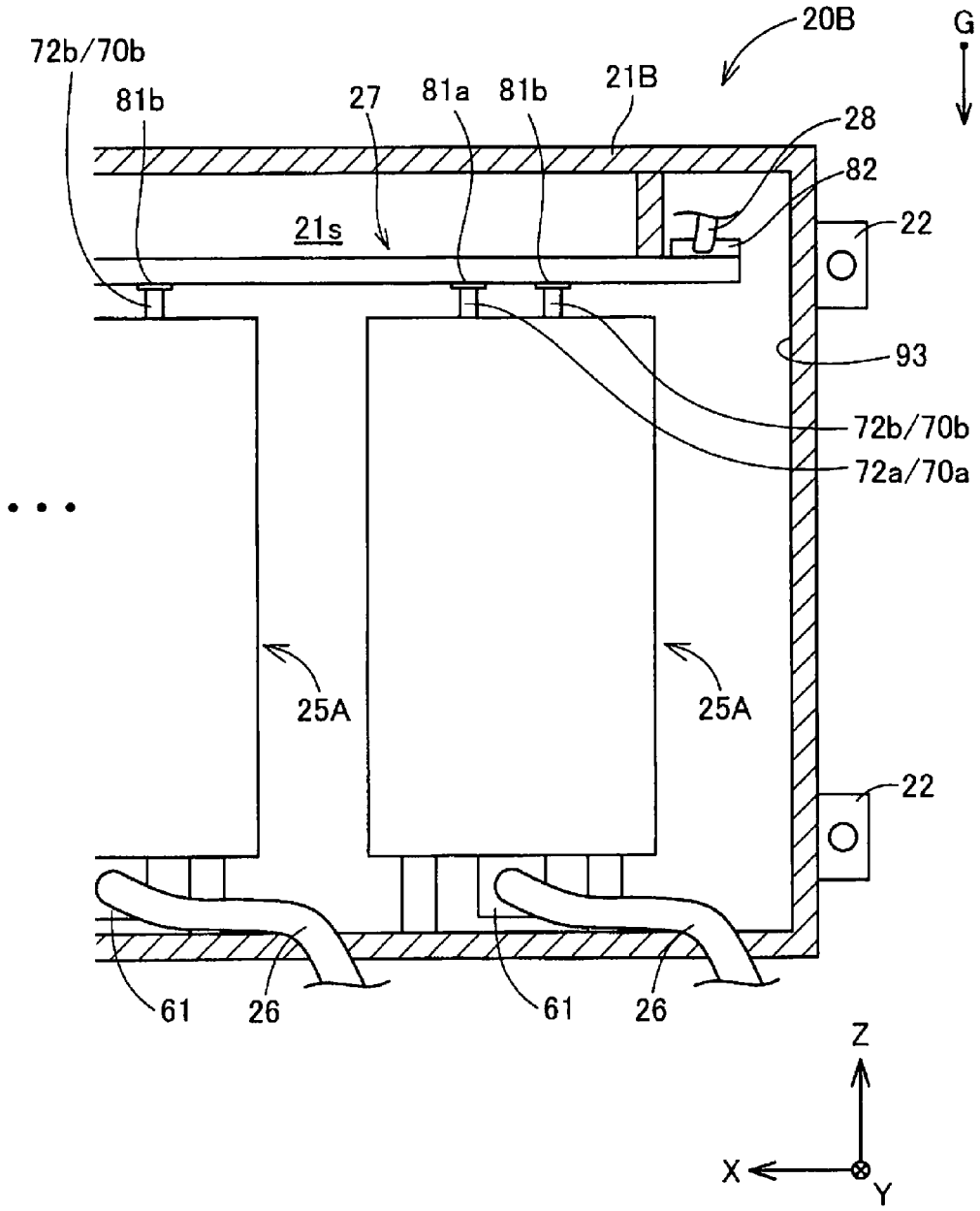
FIG. 7 is a schematic diagram showing a configuration of a tank unit of a second embodiment.

FIG. 7 is a schematic diagram showing the configuration of a tank unit 20B in a second embodiment of the invention. In FIG. 7, a portion of the back face of the tank unit 20B is illustrated in the same manner as FIG. 4. The tank unit 20B of the second embodiment has substantially the same configuration as that of the tank unit 20A described in the first embodiment except for the points described below. The configuration of a printer of the second embodiment is substantially the same as that of the printer 10 of the first embodiment (FIG. 1), except that the configuration of the tank unit 20A is different. In the following description and reference drawings, the same reference signs as those used in the first embodiment are used for constituent elements that are the same as or correspond to the constituent elements described in the first embodiment.

In the tank unit 20B, the back face wall part 90 is not provided on a casing part 21B, and a back face opening 93 is formed by the entirety of the back face side of the casing part 21B being open. In the tank unit 20B, when a coupled state with the printing part 30 is released, the entirety of the fourth face part 44 side of the ink tanks 25A is exposed to the outside via the back face opening 93. In the second embodiment, the back face opening 93 corresponds to a subordinate concept of the opening in the invention.

According to the tank unit 20B of the second embodiment, the electrical conductivity test for the pair of electrode pins 70*a* and 70*b* of each of the ink tanks 25A can be performed in a simple manner via the back face opening 93. The test apparatus 200 described in the first embodiment can be used for this test. In addition, with the tank unit 20B of the second embodiment, the opening area of the back face opening 93 is larger than the opening area of the through window 92 of the first embodiment, and therefore accessibility to the back ends 72*a* and 72*b* of the electrode pins 70*a* and 70*b* from outside of the casing part 21B is enhanced. Additionally, according to the tank unit 20B of the second embodiment and a printer that is provided therewith, it is possible to exhibit various actions and effects similar to those described in the first embodiment.

C. Third Embodiment

Figure 8:
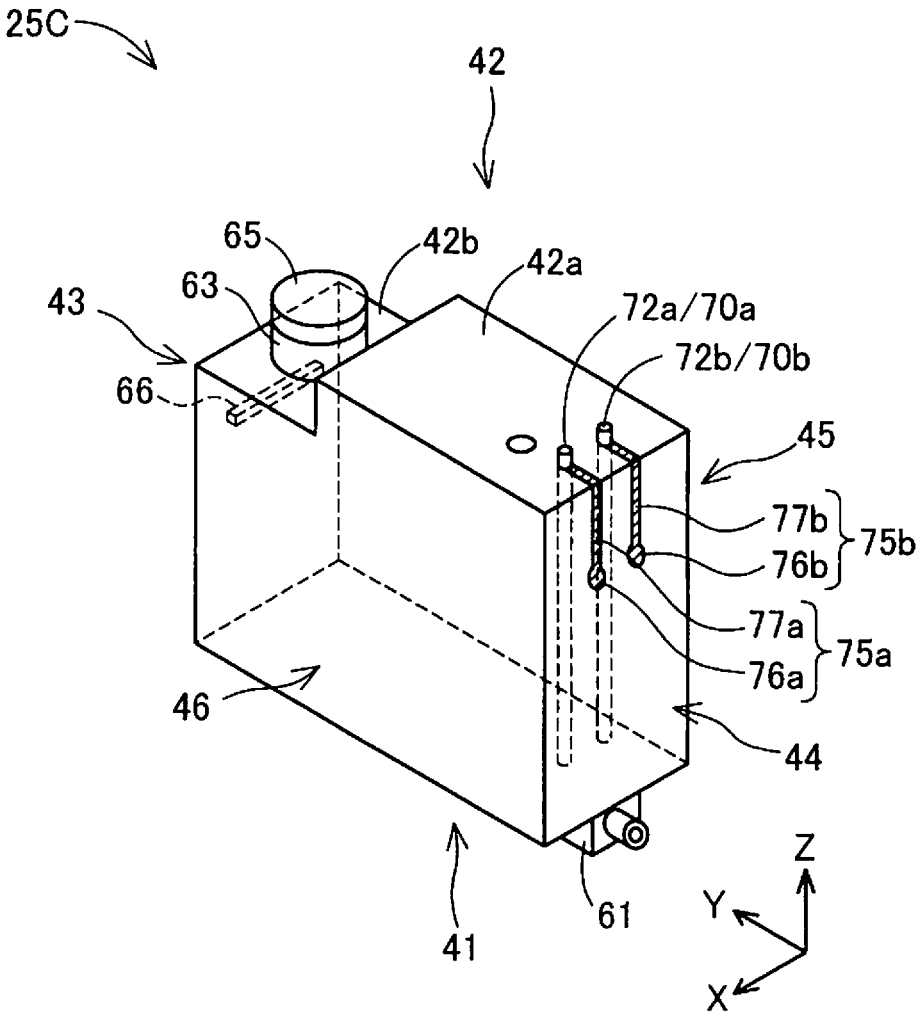
FIG. 8 is a schematic perspective diagram showing a configuration of an ink tank in a third embodiment.
Figure 9:
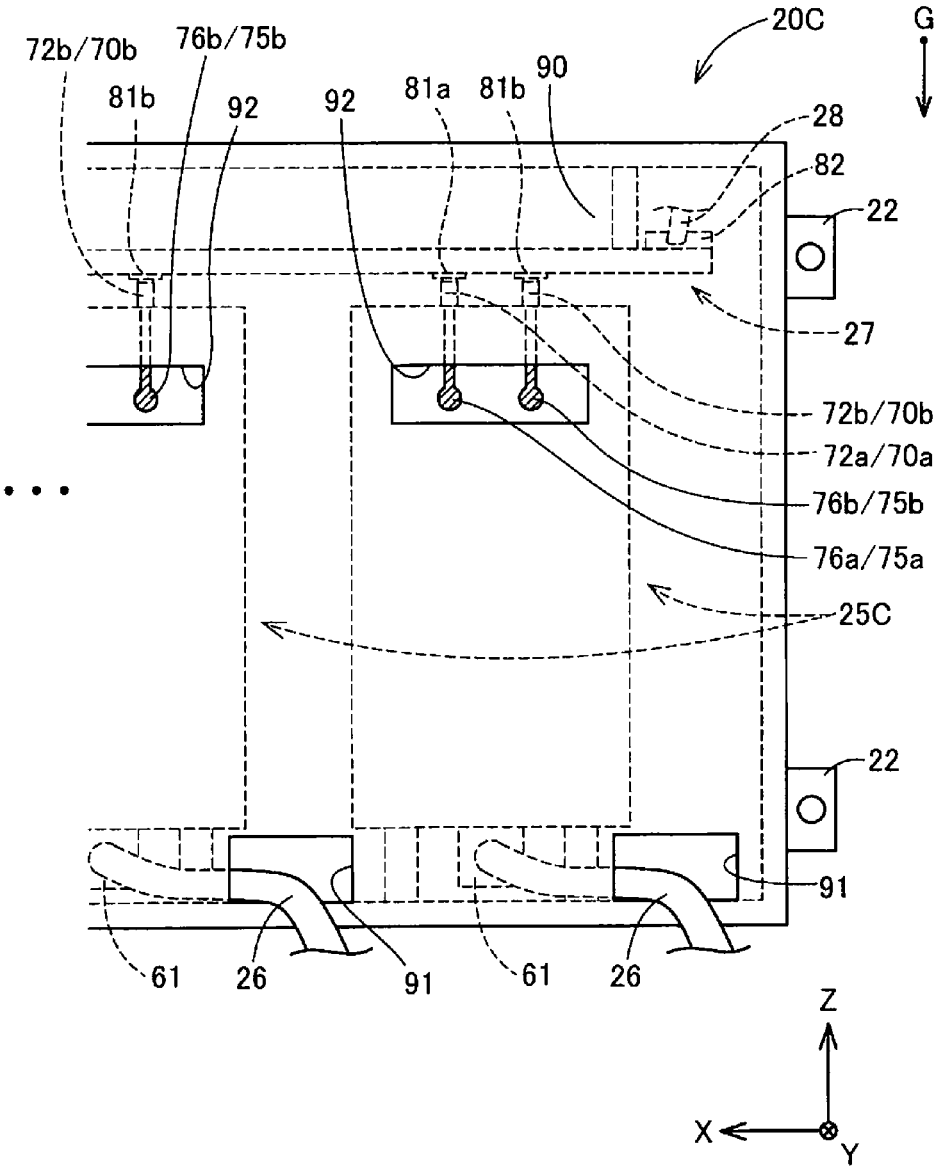
FIG. 9 is a schematic diagram showing a portion of a back face of a tank unit of the third embodiment.

The configuration of a tank unit 20C in a third embodiment will be described with reference to FIGS. 8 and 9. FIG. 8 is a schematic perspective diagram showing the configuration of an ink tank 25C provided in the tank unit 20C of the third embodiment. FIG. 9 is a schematic diagram showing a portion of the back face of the tank unit 20C of the third embodiment. The configuration of the tank unit 20C in the third embodiment is substantially the same as that of the tank unit 20A of the first embodiment except that the configuration of the ink tank 25C to be mounted is different and a forming position of the through window 92 is different. The configuration of the printer of the third embodiment is substantially the same as that of the printer 10 of the first embodiment (FIG. 1) except that the tank unit 20C is provided. In the following description and reference drawings, the same reference signs as those used in the first embodiment are used for constituent elements that are the same as or correspond to the constituent elements described in the first embodiment.

The configuration of the ink tank 25C of the third embodiment is substantially the same as that of the ink tank 25A of the first embodiment except that a pair of electrode parts 75*a* and 75*b* are provided. The first electrode part 75*a* has a first electrode pad part 76*a* and a first conductive part 77*a*. The second electrode part 75*b* has a second electrode pad part 76*b* and a second conductive part 77*b*.

The first electrode pad part 76*a* and the second electrode pad part 76*b* have substantially the same size and a substantially disk shape, and are arranged in the direction of the arrow X at substantially the same height position on the fourth face part 44. The first electrode pad part 76*a* is formed at a position overlapping the first electrode pin 70*a*, and the second electrode pad part 76*b* is formed at a position overlapping the second electrode pin 70*b* when the ink tank 25C is viewed in the direction of the arrow Y.

The first conductive part 77*a* extends between and electrically connects the first electrode pad part 76*a* and the back end 72*a* of the first electrode pin 70*a*. Similarly, the second conductive part 77*b* extends between and electrically connects the second electrode pad part 76*b* and the back end 72*b* of the second electrode pin 70*b*. The pair of electrode parts 75*a* and 75*b* may be formed by screen printing using conductive paste or the like, or may be formed with a conductive plate-like member such as a metal plate.

In the tank unit 20C of the third embodiment, when the through windows 92 of the back face wall part 90 are viewed in the direction of the arrow Y, which is the opening direction thereof, the electrode pad parts 76*a* and 76*b* on the fourth face part 44 are positioned in the through windows 92. In the tank unit 20C, the back ends 72*a* and 72*b* of the electrode pins 70*a* and 70*b* are not exposed from the through windows 92, and the electrode pad parts 76*a* and 76*b* are exposed. Note that the electrode pad parts 76*a* and 76*b* are electrically conductive with the back ends 72*a* and 72*b* of the electrode pins 70*a* and 70*b*, and thus can be interpreted as portions of terminal parts of the ink tank 25C that enable electrical connection to the outside.

According to the tank unit 20C of the third embodiment, the electrical conductivity test for the electrode pins 70*a* and 70*b* in each of the ink tanks 25C can be performed via the electrode pad parts 76*a* and 76*b* exposed from the through windows 92. For this test, the test apparatus 200 that is similar to that described in the first embodiment can be used. In addition, with the tank unit 20C of the third embodiment, a connection section between the circuit unit 27 and the electrode pins 70*a* and 70*b* itself is not exposed from the through window 92, and thus the ability to protect the connection section is enhanced. Additionally, with the tank unit 20C of the third embodiment and a printer that is provided therewith, it is possible to exhibit various actions and effects similar to those described in the first embodiment.

D. Fourth Embodiment

Figure 10:
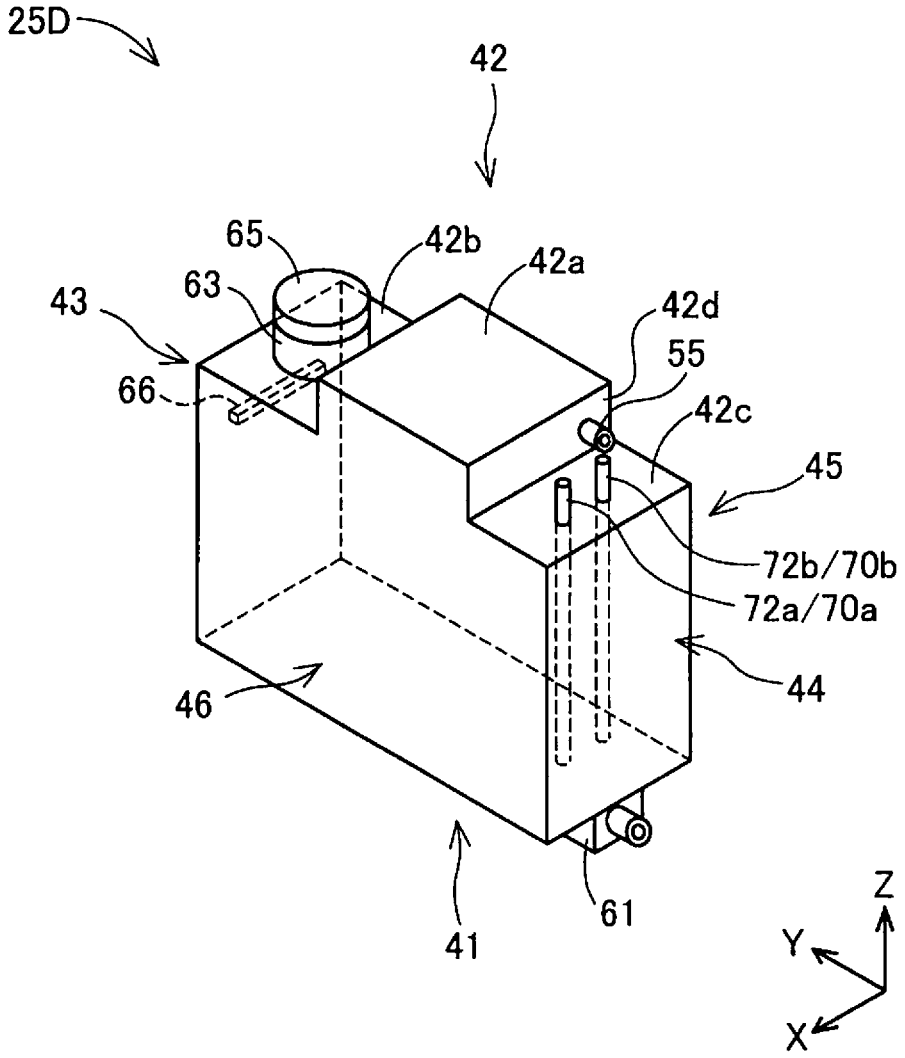
FIG. 10 is a schematic perspective diagram showing an appearance configuration of an ink tank in a fourth embodiment.
Figure 11:
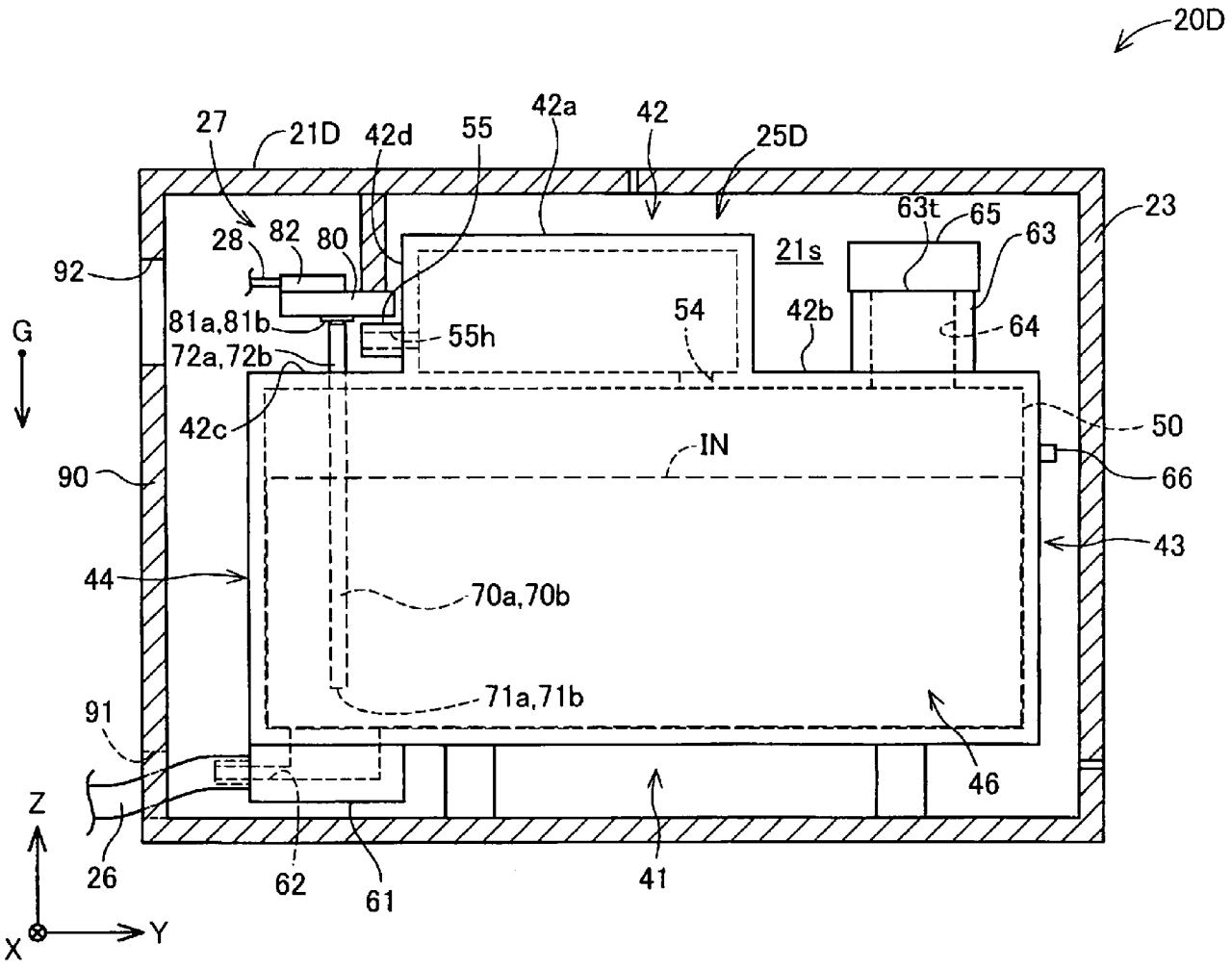
FIG. 11 is a schematic cross-sectional diagram showing an internal configuration of a tank unit in the fourth embodiment.
Figure 12:
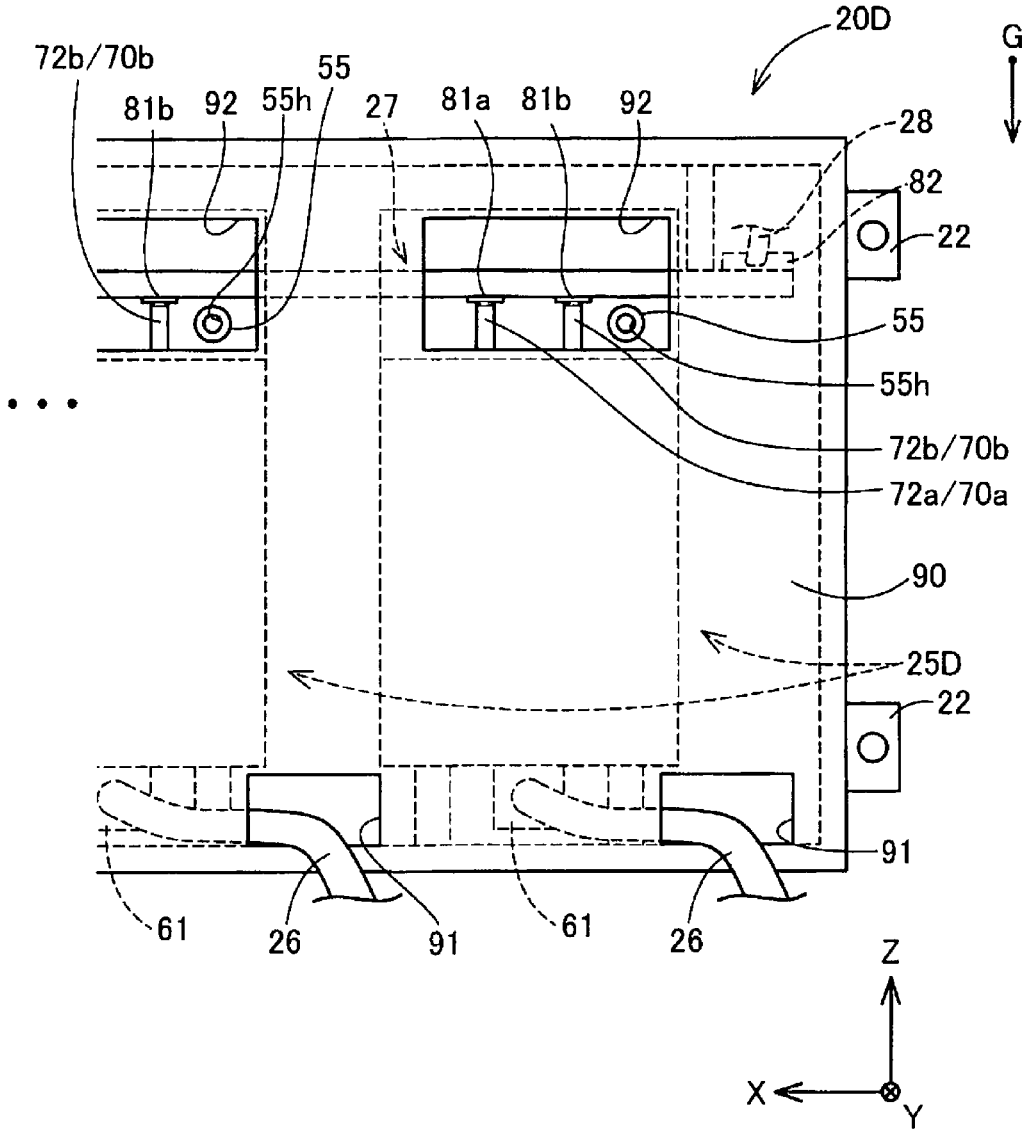
FIG. 12 is a schematic diagram showing a portion of a back face of the tank unit in the fourth embodiment.

The configurations of a tank unit 20D and an ink tank 25D in a fourth embodiment will be described with reference to FIGS. 10 to 12. FIG. 10 is a schematic perspective diagram showing the appearance configuration of the ink tank 25D of the fourth embodiment. FIG. 11 is a schematic cross-sectional diagram showing the internal configuration of the tank unit 20D of the fourth embodiment, and is a diagram of the mounted ink tank 25D viewed in a direction facing the sixth face part 46. In FIG. 11, portions of the internal configuration of the ink tank 25D are schematically illustrated with broken lines. FIG. 12 is a schematic diagram showing a portion of the back face of the tank unit 20D of the fourth embodiment. The configuration of the tank unit 20D in the fourth embodiment is substantially the same as that of the tank unit 20A of the first embodiment, except that the configuration of the ink tank 25D is different. The configuration of a printer of the fourth embodiment is substantially the same as that of the printer 10 (FIG. 1) of the first embodiment except that the tank unit 20D is provided. In the following description and reference drawings, the same reference signs as those used in the first embodiment are used for constituent elements that are the same as or correspond to the constituent elements described in the first embodiment.

The configuration of the ink tank 25D provided in the tank unit 20D of the fourth embodiment is substantially the same as that of the ink tank 25A of the first embodiment except for the points described below. A third upper face part 42*c* that is at substantially the same height position as the second upper face part 42*b* is provided in the end region of the second face part 42 of the ink tank 25D on the fourth face part 44 side (FIGS. 10 and 11). The first upper face part 42*a* is sandwiched in the front-back direction by the second upper face part 42*b* on the third face part 43 side and the third upper face part 42*c* on the fourth face part 44 side. A level difference face 42*d* that is a face directed in a direction opposite to the direction of the arrow Y is formed between the third upper face part 42*c* and the first upper face part 42*a*.

In the ink tank 25D, the ink container 50 is formed in a region below the second upper face part 42*b* and the third upper face part 42*c* (FIG. 11). In addition, the atmospheric air introduction part 51 is formed at a position that is below the first upper face part 42*a* and is above the ink container 50, and is formed at a position adjacent to the level difference face 42*d* in the direction of the arrow Y.

In the ink tank 25D, the pair of electrode pins 70*a* and 70*b* are attached such that the back ends 72*a* and 72*b* thereof protrude upward in the third upper face part 42*c* (FIG. 10). In the tank unit 20D, the circuit unit 27 is connected above the third upper face part 42*c* to the back ends 72*a* and 72*b* of the electrode pins 70*a* and 70*b* (FIG. 11).

In the ink tank 25D, an atmospheric air intake part 55 is provided in the level difference face 42*d* (FIGS. 10 and 11). The atmospheric air intake part 55 is a section that allows the atmospheric air chamber 52 of the atmospheric air introduction part 51 to communicate with the outside, and is constituted as a cylindrical section that protrudes from the level difference face 42*d* in a direction opposite to the direction of the arrow Y. In the ink tank 25D, a through hole 55*h* of the atmospheric air intake part 55 functions as an atmospheric air intake port for introducing atmospheric air into the atmospheric air chamber 52. The atmospheric air intake part 55 is formed at substantially the same height position as the end faces of the back ends 72*a* and 72*b* of the electrode pins 70*a* and 70*b*.

In a posture when the tank unit 20D is coupled to the printing part 30, the back ends 72*a* and 72*b* of the electrode pins 70*a* and 70*b* and the atmospheric air intake part 55 are arranged at positions that are above the ink container 50 and are closer to the printing part 30 than the ink injection part 63. That is, the back ends 72*a* and 72*b* of the electrode pins 70*a* and 70*b* and the atmospheric air intake part 55 are closely arranged in an upper region of the back face side of the ink tank 25D. Accordingly, the ability to perform testing and maintenance of the ink tank 25D via the through windows 92 is enhanced.

In the ink tank 25D, the atmospheric air introduction part 51 is provided so as to protrude upward between the back ends 72*a* and 72*b* of the electrode pins 70*a* and 70*b* and the ink injection part 63. Therefore, the flying of ink droplets from the ink injection part 63 to the back ends 72*a* and 72*b* of the electrode pins 70*a* and 70*b* is restrained by a wall part constituting the atmospheric air introduction part 51. Therefore, ink is restrained from adhering to the back ends 72*a* and 72*b* of the electrode pins 70*a* and 70*b* when the ink is replenished via the ink injection part 63.

The back ends 72*a* and 72*b* of the electrode pins 70*a* and 70*b* and the atmospheric air intake part 55 are positioned in a region in the through windows 92 when the through windows 92 of the back face wall part 90 in a casing part 21D is viewed in the direction of opening thereof (FIG. 12). That is, in the tank unit 20D, the atmospheric air intake part 55 of the ink tank 25D is exposed, along with the back ends 72*a* and 72*b* of the pair of electrode pins 70*a* and 70*b*, to the outside from the through window 92 of the back face wall part 90. In addition, the through hole 55*h* of the atmospheric air intake part 55 is open toward the through window 92. Accordingly, in the tank unit 20D, the electrical conductivity test for the electrode pins 70*a* and 70*b* of each of the ink tanks 25D and the air tightness test in each of the ink tanks 25D using the atmospheric air intake part 55 can be performed in a simple manner via the through windows 92.

Figure 13:
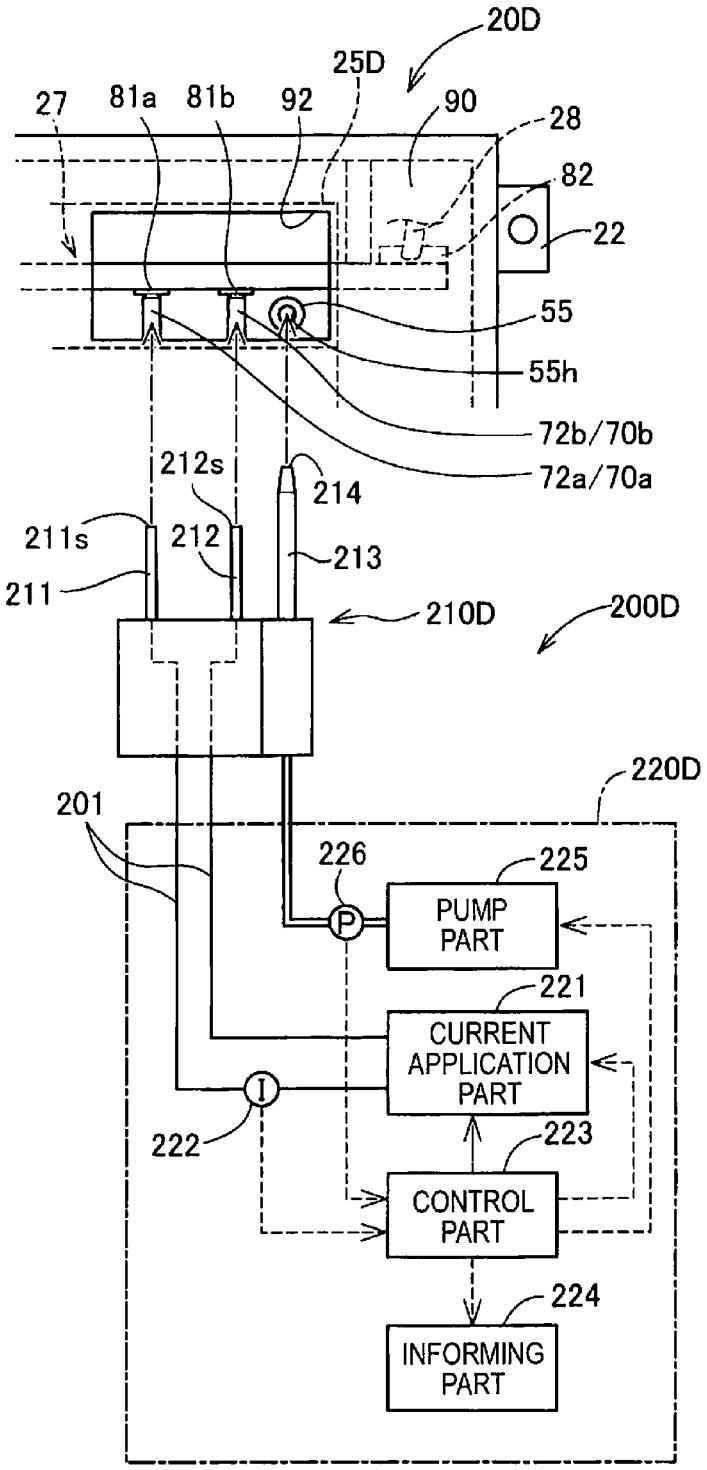
FIG. 13 is a schematic diagram showing a configuration of a test apparatus in the fourth embodiment.
Figure 14:
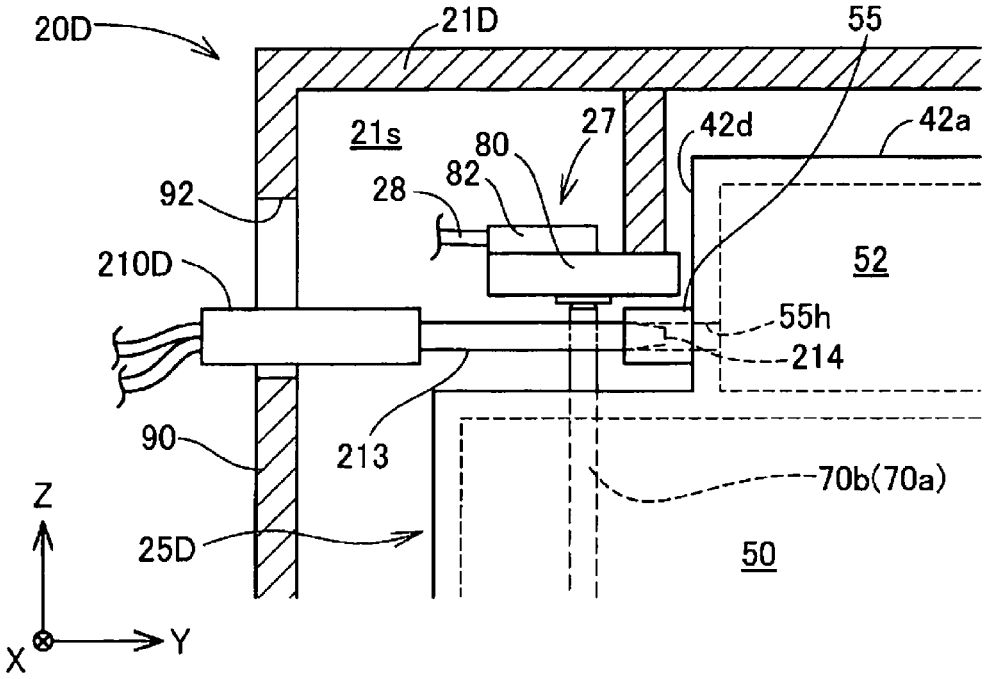
FIG. 14 is a schematic diagram showing a state in which a test is being performed by the test apparatus of the fourth embodiment.

An example of a method of the electrical conductivity test for the electrode pins 70*a* and 70*b* of each of the ink tanks 25D and the air tightness test in the ink tank 25D using the atmospheric air intake part 55 will be described with reference to FIGS. 13 and 14. FIG. 13 is a schematic diagram showing the configuration of a test apparatus 200D used for a test of the ink tank 25D. In FIG. 13, a section in the tank unit 20D that is near the through window 92 is also illustrated. FIG. 14 is a schematic diagram showing a state in which a test is being performed using the test apparatus 200D. In FIG. 14, a connection section between the circuit unit 27 and the ink tank 25D and the atmospheric air intake part 55 when viewed in the direction of the arrow X are illustrated.

The test apparatus 200D in the fourth embodiment is substantially the same as the test apparatus 200 in the first embodiment except for the points described below. In the test apparatus 200D, a nozzle part 213 is added to a connecter part 210D, and a tube 202, a pump part 225, and a pressure measurement part 226 are added to the body part 220D (FIG. 13).

The nozzle part 213 is connected to the pump part 225 of the body part 220D via the tube 202, and can jet, from a top end opening 214, high-pressure air sent out from the pump part 225. The pump part 225 is driven under the control by the control part 223, at a predetermined rotational frequency. The pressure measurement part 226 is attached to the tube 202, and measures the air pressure in the tube 202. The pressure measurement part 226 transmits a signal indicating a measurement result to the control part 223.

The nozzle part 213 is integrally coupled to the pair of pin terminals 211 and 212 in the connecter part 210D. The nozzle part 213 is constituted such that the top end opening of the nozzle part 213 is connected to the through hole 55*h* of the atmospheric air intake part 55 when the pin terminals 211 and 212 come into contact with the back ends 72*a* and 72*b* of the corresponding electrode pins 70*a* and 70*b* (FIG. 14).

The air tightness test for the atmospheric air intake part 55 using the test apparatus 200D is performed in the following manner. Note that the content of the electrical conductivity test for the electrode pins 70*a* and 70*b* performed by the test apparatus 200D is substantially the same as that described in the first embodiment, and thus the description thereof is omitted.

The connecter part 210D is inserted from the through window 92, and when the pin terminals 211 and 212 come in contact with the back ends 72*a* and 72*b* of the corresponding electrode pins 70*a* and 70*b*, the top end opening 214 of the nozzle part 213 is connected to the through hole 55*h* of the atmospheric air intake part 55 (FIG. 14). When applying a current to the electrode pins 70*a* and 70*b* using the current application part 221, the control part 223 simultaneously drives the pump part 225 so as to send out high-pressure air from the nozzle part 213 to the atmospheric air introduction part 51 via the atmospheric air intake part 55.

When the pressure value in the tube 202 after driving of the pump part 225 is less than or equal to a predetermined threshold, the control part 223 informs the user via the informing part 224 that there is the possibility that the air tightness of the ink tank 25D has not been secured. Note that if the air tightness of the ink tank 25D decreases, there is the possibility that the ability to supply ink from the ink tank 25D decreases. Therefore, the air tightness test of this ink tank 25D can be interpreted as a test regarding ink supply capability in the ink tank 25D.

As described above, according to the tank unit 20D of the fourth embodiment, the electrical conductivity test and the air tightness test in the ink tank 25D can be performed in a simple manner via the through windows 92. In addition, with the use of the test apparatus 200D of the fourth embodiment, both the tests can be performed at the same time. Additionally, according to the tank unit 20D of the fourth embodiment and a printer that is provided therewith, it is possible to exhibit various actions and effects similar to those described in the first embodiment.

E. Fifth Embodiment

Figure 15:
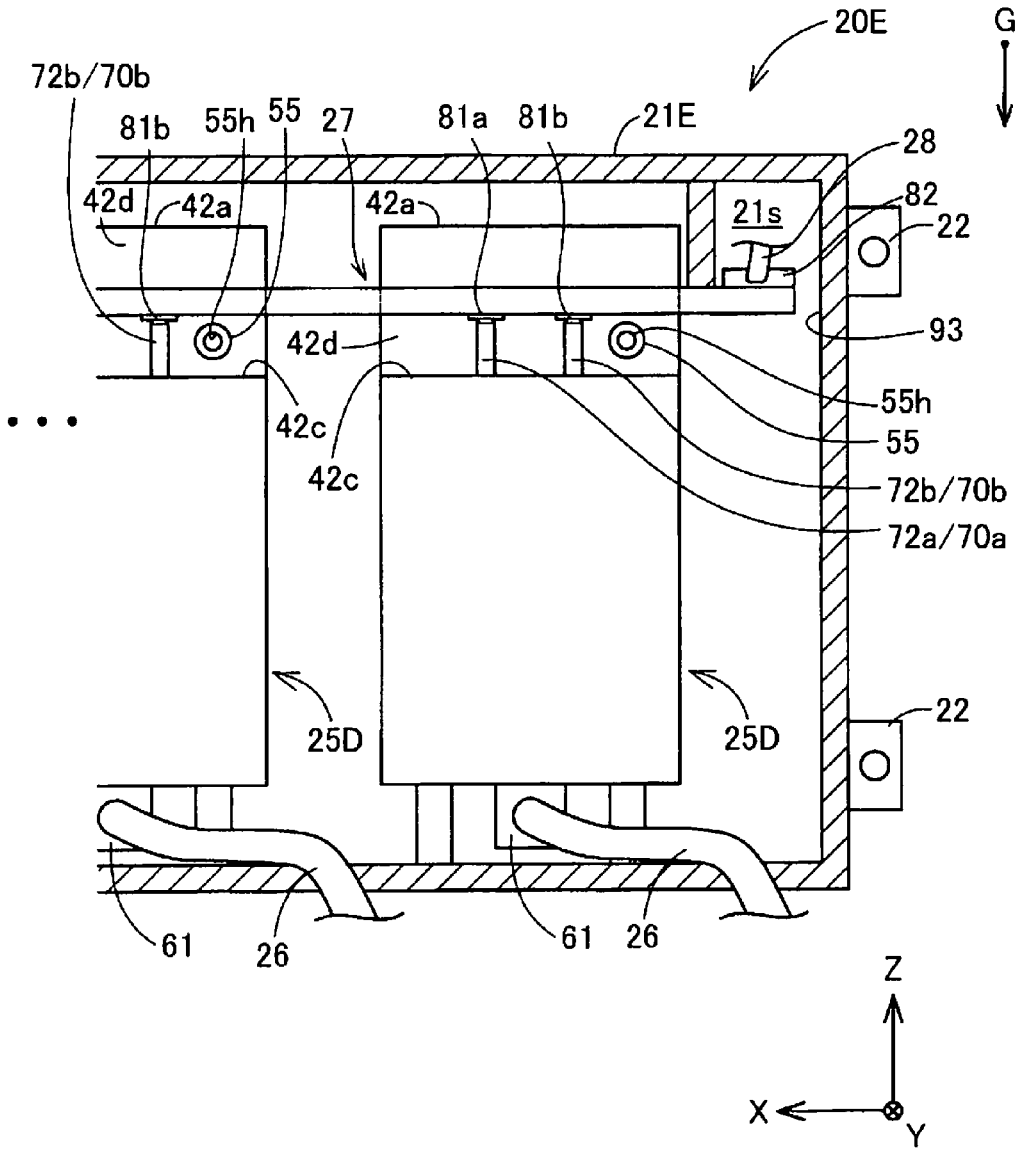
FIG. 15 is a schematic diagram showing a configuration of a tank unit in a fifth embodiment.

FIG. 15 is a schematic diagram showing the configuration of a tank unit 20E in a fifth embodiment of the invention. In FIG. 15, a portion of the back face of the tank unit 20E is illustrated in the same manner as FIG. 13. The tank unit 20E of the fifth embodiment has the substantially the same configuration as that of the tank unit 20D described in the fourth embodiment except for the points described below. The configuration of a printer of the fifth embodiment is substantially the same as that of the printer 10 of the first embodiment (FIG. 1) except that the tank unit 20E is provided. In the following description and reference drawings, the same reference signs as those used in the fourth embodiment are used for constituent elements that are the same as or correspond to the constituent elements described in the fourth embodiment.

In the tank unit 20E, the back face opening 93 is formed by the entirety of the back face side of a casing part 21E being open. Accordingly, in the tank unit 20E, when a coupled state with the printing part 30 is released, the entirety of the fourth face part 44 side of the ink tanks 25D is exposed to the outside via the back face opening 93. In the fifth embodiment the back face opening 93 corresponds to a subordinate concept of the opening in the invention, similarly to the second embodiment.

According to the tank unit 20E of the fifth embodiment, the electrical conductivity test for the pair of electrode pins 70*a* and 70*b* of each of the ink tanks 25D can be performed in a simple manner via the back face opening 93. In addition, the air tightness test of the ink tank 25D can be performed in a simple manner using the atmospheric air intake part 55. For these tests, the test apparatuses 200 and 200D respectively described in the first embodiment and the fourth embodiment can be used. In addition, with the tank unit 20D of the fifth embodiment, the opening area of the back face opening 93 is larger than the opening area of the through window 92 of the fourth embodiment, and therefore accessibility to the back ends 72*a* and 72*b* of the electrode pins 70*a* and 70*b* and the atmospheric air intake part 55 from outside of the casing part 21E is enhanced. Additionally, according to the tank unit 20E of the fifth embodiment and a printer that is provided therewith, it is possible to exhibit various actions and effects similar to those described in the above embodiments.

F. Sixth Embodiment

Figure 16:
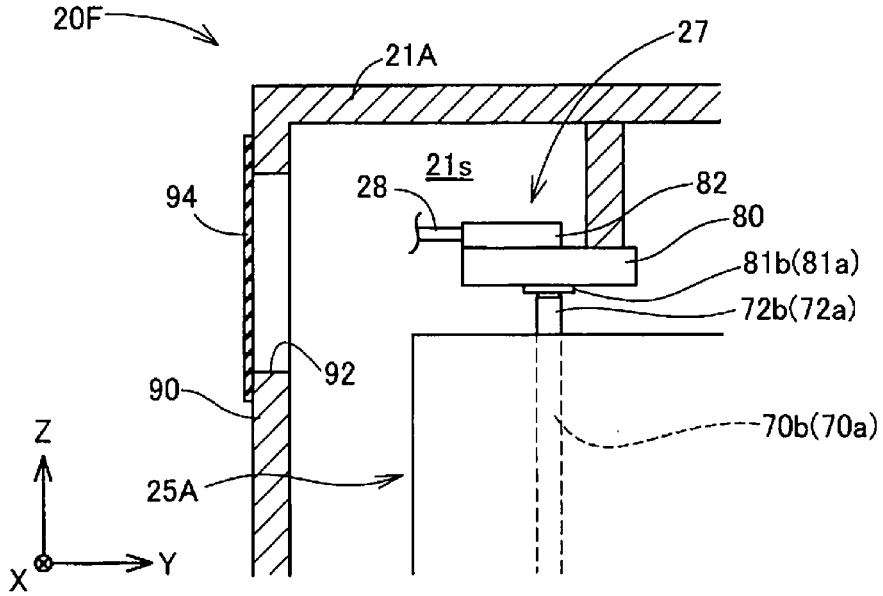
FIG. 16 is a schematic cross-sectional diagram showing a configuration of a tank unit in a sixth embodiment.

FIG. 16 is a schematic cross-sectional diagram showing the configuration of a tank unit 20F in a sixth embodiment of the invention. In FIG. 16, a section near the through windows 92 in a cross section perpendicular to the direction of the arrow X is illustrated. The configuration of the tank unit 20F of the sixth embodiment is substantially the same as that of the tank unit 20A of the first embodiment, except for the points described below. The configuration of a printer of the sixth embodiment is substantially the same as that of the printer 10 of the first embodiment (FIG. 1) except that the tank unit 20F is provided. In the following description and reference drawings, the same reference signs as those used in the first embodiment are used for constituent elements that are the same as or correspond to the constituent elements described in the first embodiment.

In the tank unit 20F of the sixth embodiment, the through window 92 of the back face wall part 90 is sealed by a sealing member 94. The sealing member 94 is constituted by a film member made of resin, for example, and the outer periphery thereof is welded to the inner periphery of the through windows 92. In the tank unit 20F, the electrical conductivity test for the electrode pins 70*a* and 70*b* of the ink tank 25A can be performed by removing the sealing member 94 from the through window 92 or by tearing the sealing member 94. According to the tank unit 20F of the sixth embodiment, even in a state where a coupled state with the printing part 30 is released, intrusion of a foreign material or the like from the through windows 92 is restrained by the sealing member 94, and the ability to protect the tank unit 20F is improved.

Figure 17:
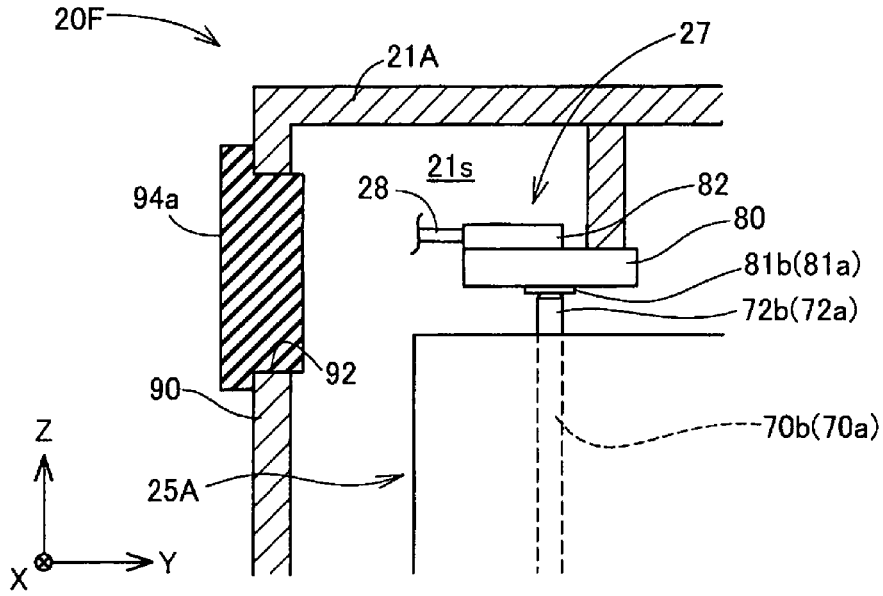
FIG. 17 is a schematic cross-sectional diagram showing another configuration example of a sealing member in the sixth embodiment.
Figure 18:
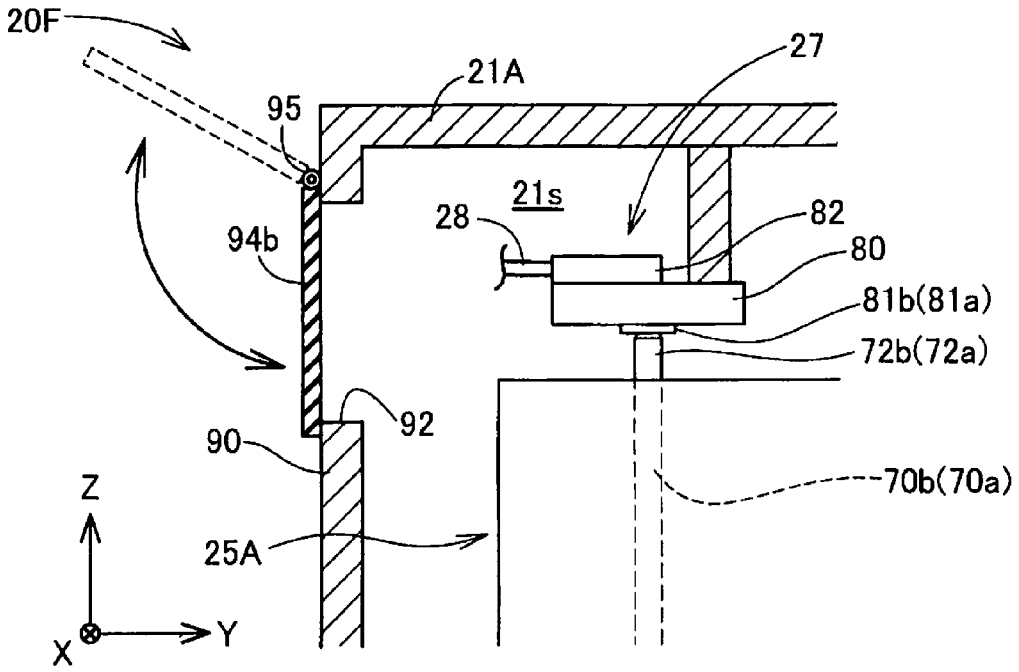
FIG. 18 is a schematic cross-sectional diagram showing another configuration example of the sealing member in the sixth embodiment.

Another configuration example of the sealing member 94 will be described with reference to FIGS. 17 and 18. In FIGS. 17 and 18, schematic cross sections of the tank unit 20F to which sealing members 94*a* and 94*b* having different configurations are attached are respectively illustrated in the same manner as FIG. 16. The sealing member 94*a* is constituted as a cap member made of resin that is embedded in the through window 92 (FIG. 17). The sealing member 94*a* is attached so as to fit the through window 92, and thus the ability to be attached to and detached from the through window 92 is enhanced. The sealing member 94*b* is constituted by a plate-like member made of resin or the like, and is coupled to the back face wall part 90 using a hinge mechanism 95 so as to be able to open and close the through windows 92. With the sealing member 94*b*, access to the electrode pins 70*a* and 70*b* via the through window 92 becomes easy.

As described above, according to the tank unit 20F of the sixth embodiment, intrusion of a foreign material into the tank unit 20F or the like is restrained by the sealing members 94, 94*a* and 94*b*. Additionally, according to the tank unit 20F of the sixth embodiment and a printer that is provided therewith, it is possible to exhibit various actions and effects similar to those described in the first embodiment. Note that the configurations of the sealing members 94, 94*a* and 94*b* of the sixth embodiment may be applied to the tank unit 20C of the third embodiment and the through window 92 of the tank unit 20D of the fourth embodiment. In addition, the sealing members 94, 94*a* and 94*b* may be attached to the tank unit 20B of the second embodiment or the tank unit 20E of the fifth embodiment so as to seal a portion of or the entire back face opening 93.

G. Seventh Embodiment

Figure 19:
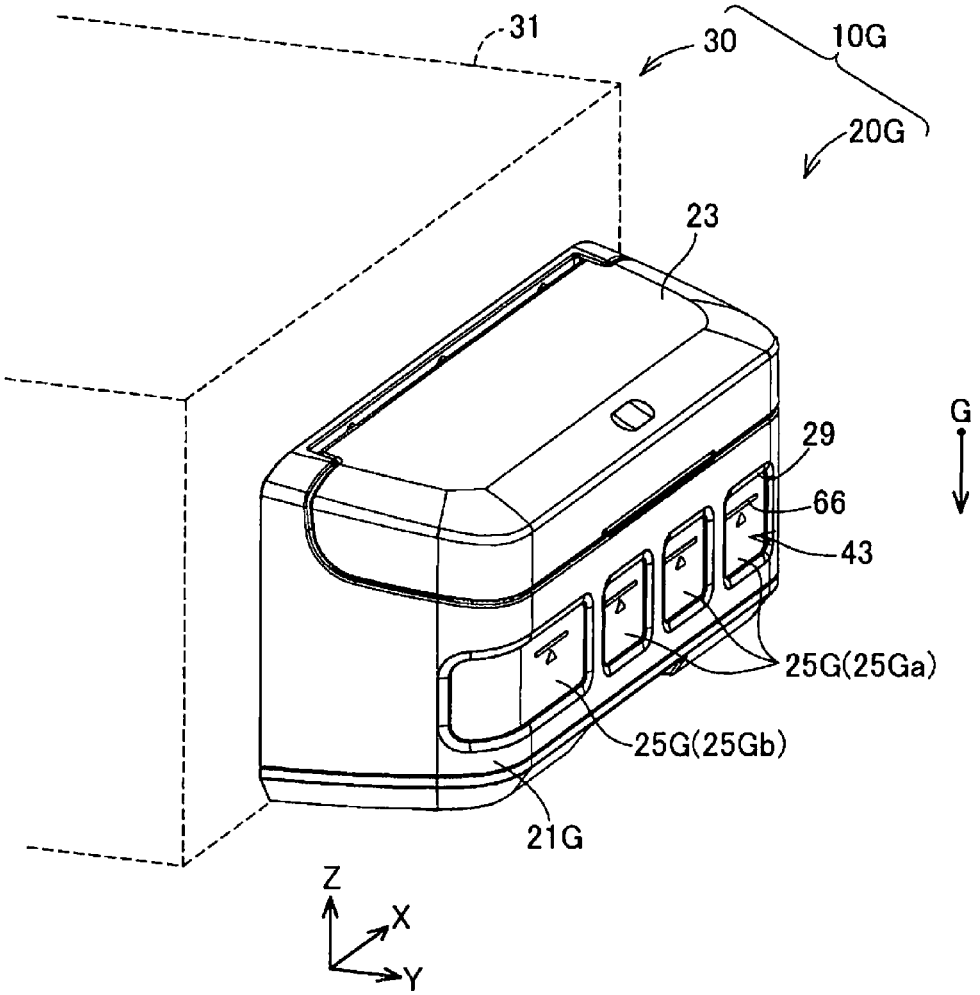
FIG. 19 is a schematic perspective diagram showing a configuration of a printer in a seventh embodiment.
Figure 20:
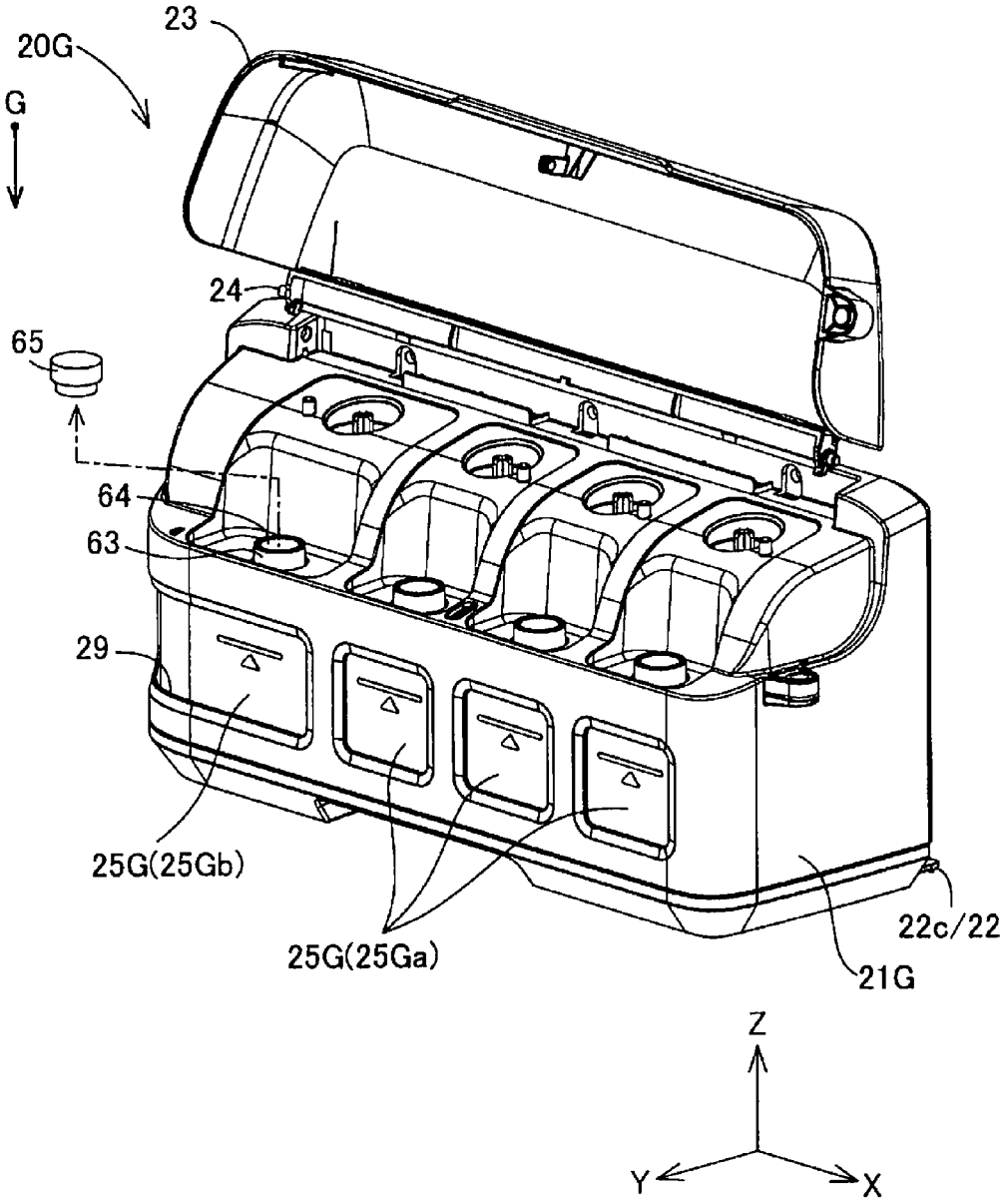
FIG. 20 is a schematic perspective diagram showing a tank unit in the seventh embodiment.
Figure 21:
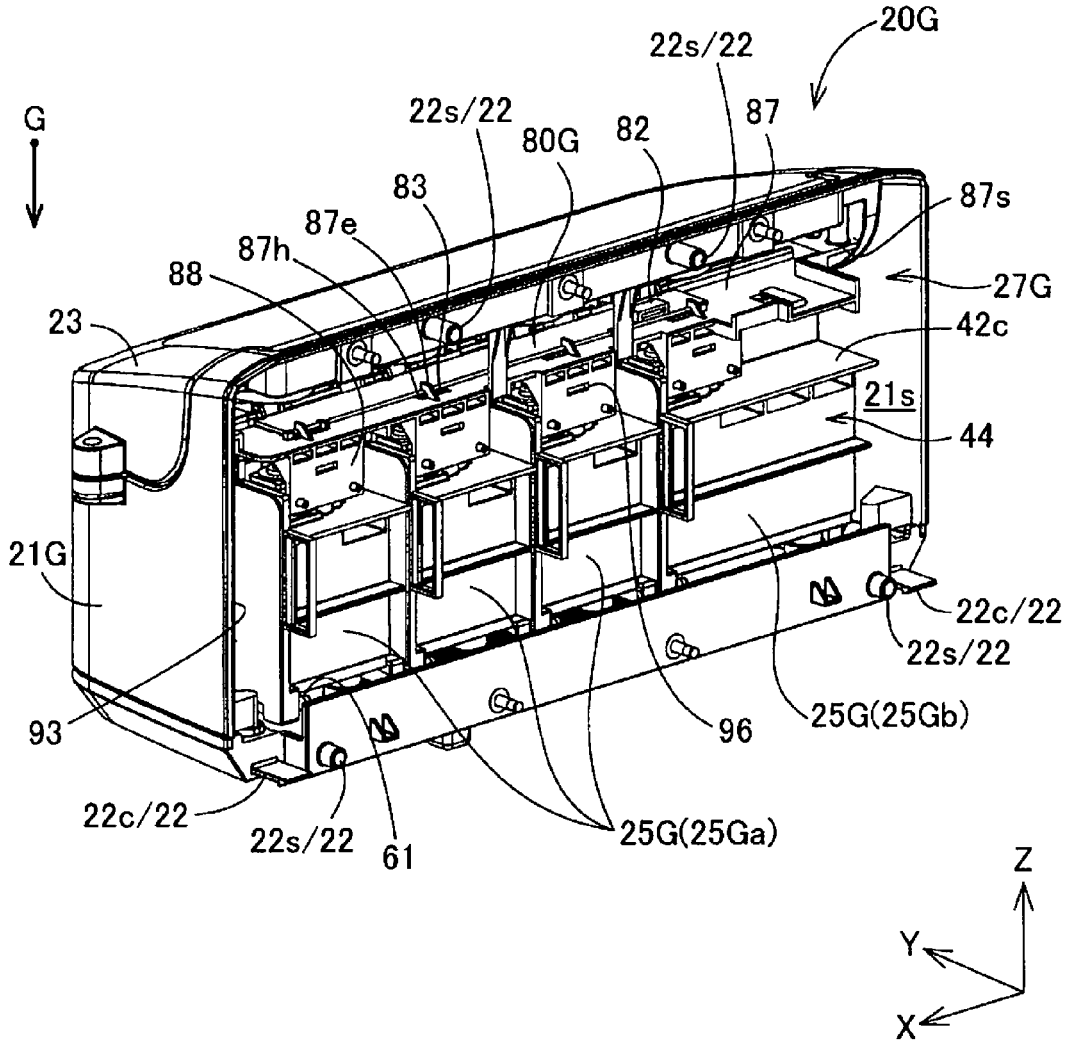
FIG. 21 is a schematic perspective diagram showing a back face side of a tank unit in the seventh embodiment.
Figure 22:
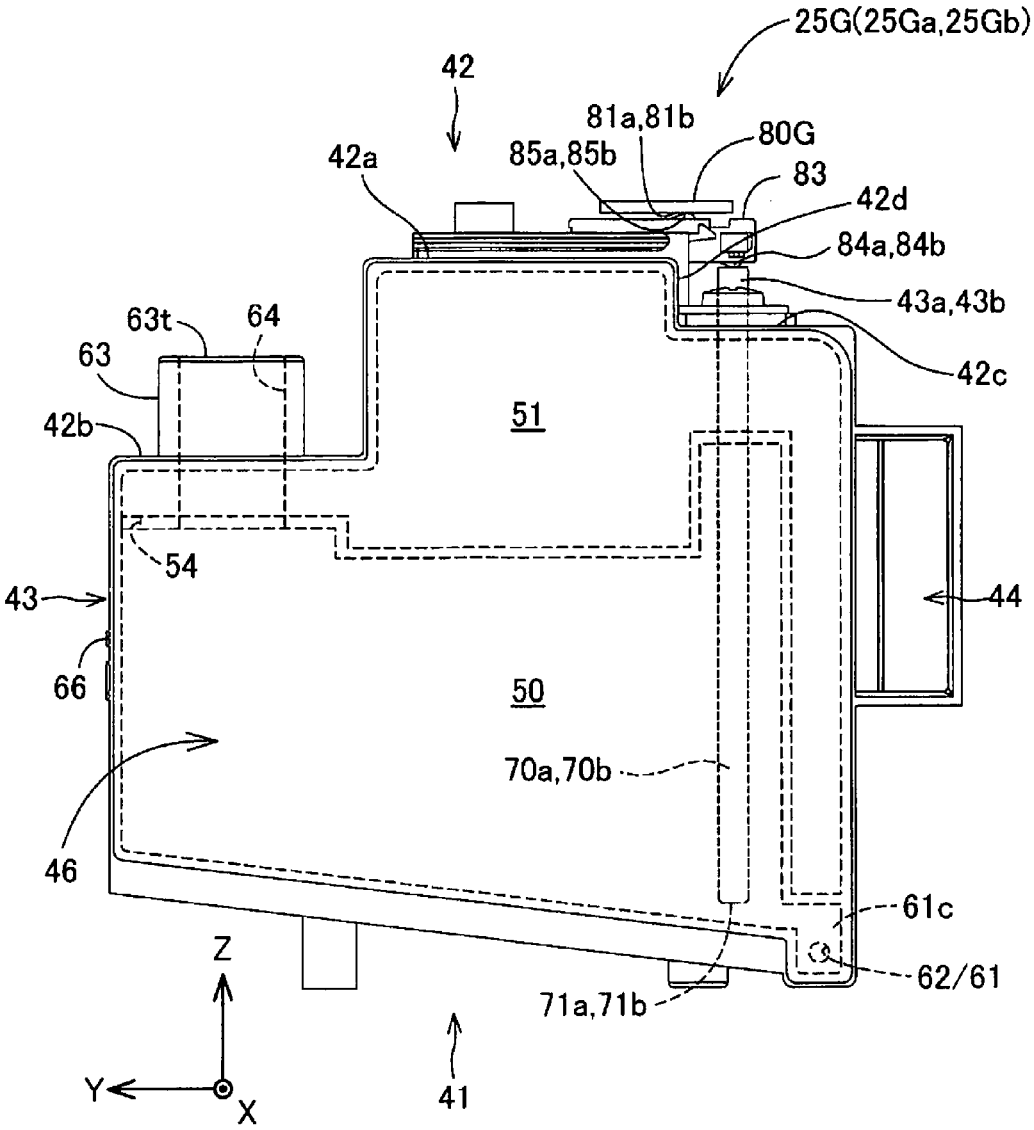
FIG. 22 is a schematic side view of an ink tank in the seventh embodiment.
Figure 23:
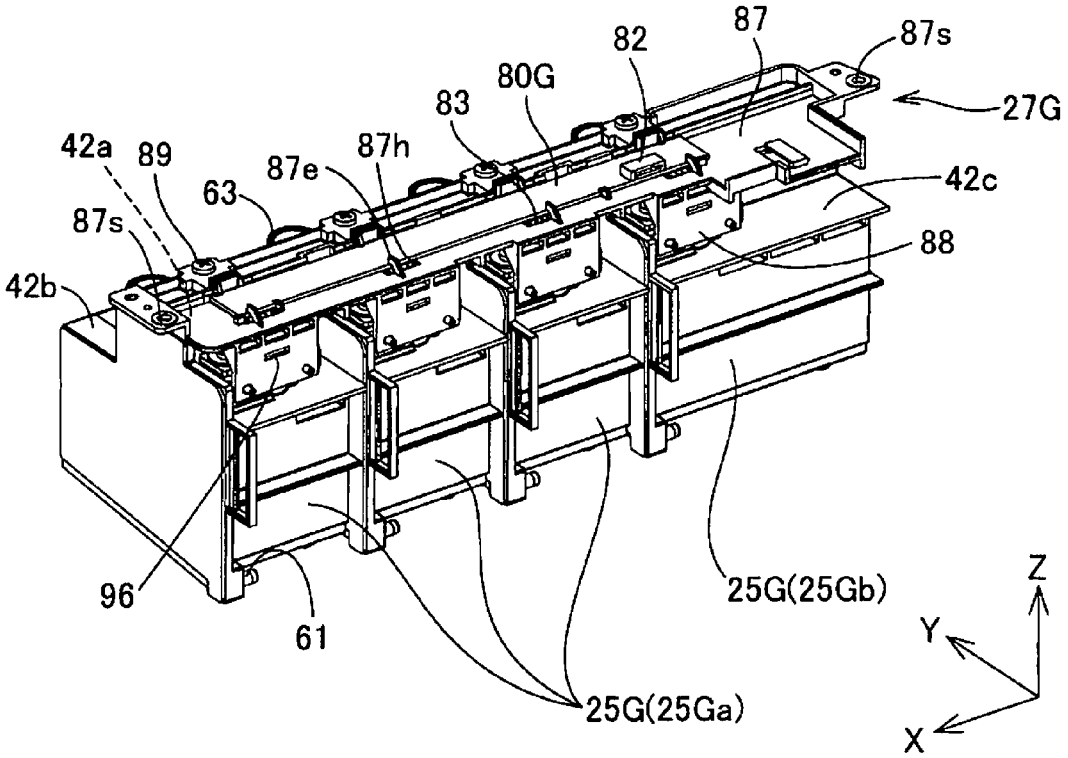
FIG. 23 is a schematic perspective diagram showing a state in which a circuit unit is attached to the ink tank in the seventh embodiment.
Figure 24:
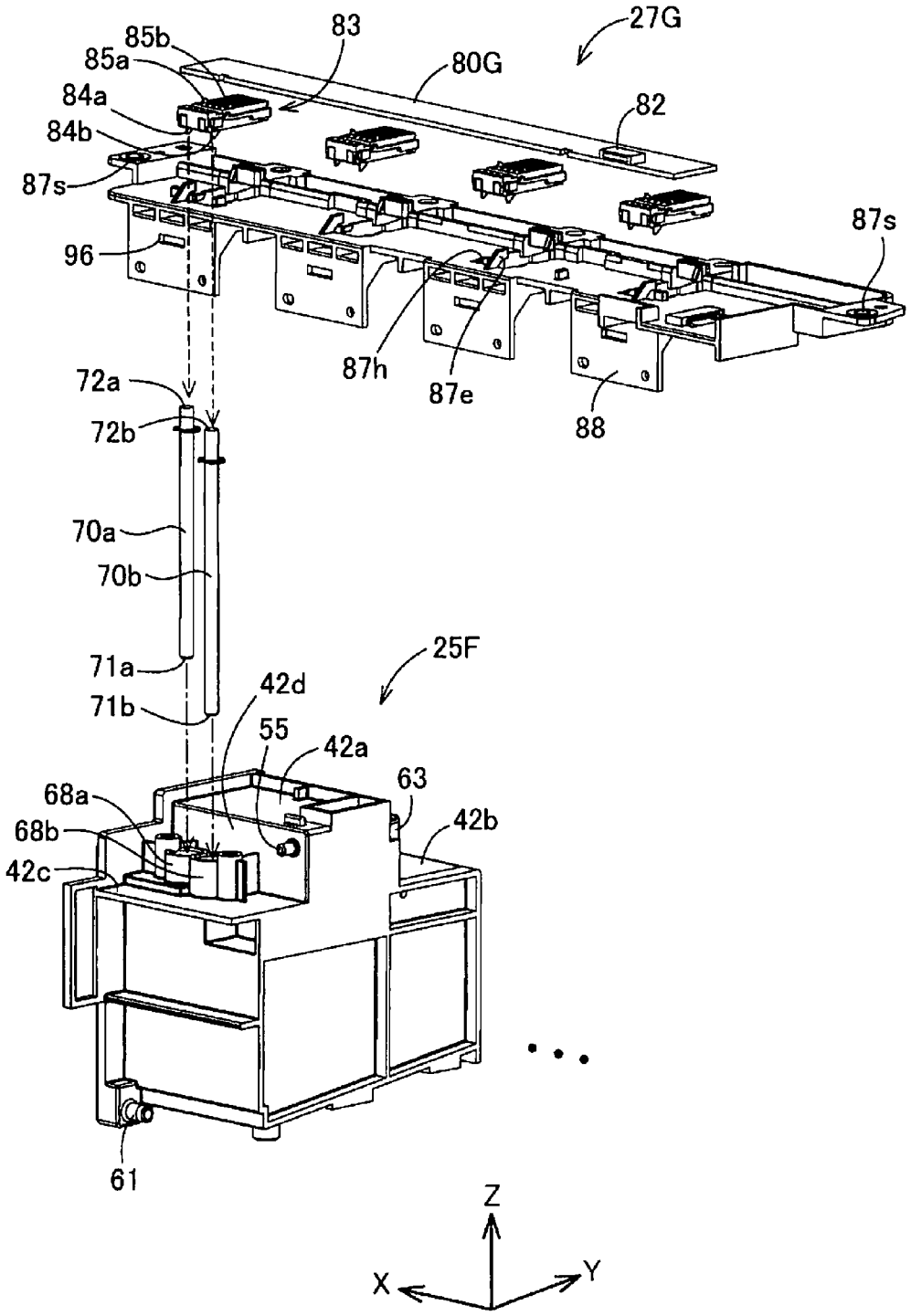
FIG. 24 is a schematic exploded perspective diagram of the ink tank and the circuit unit in the seventh embodiment.
Figure 25:
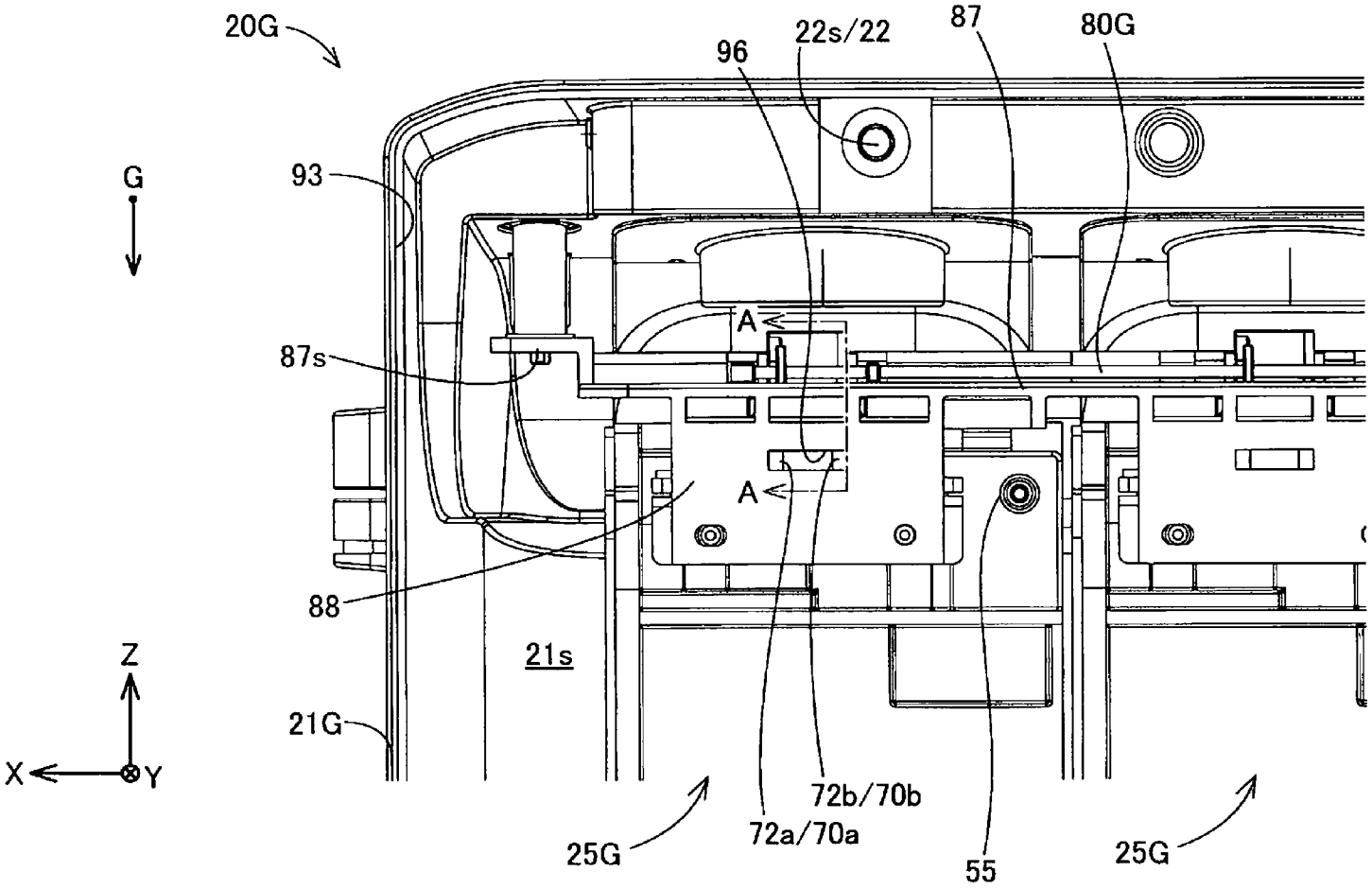
FIG. 25 is a schematic rear view showing a portion of a back face of the tank unit in the seventh embodiment.
Figure 26:
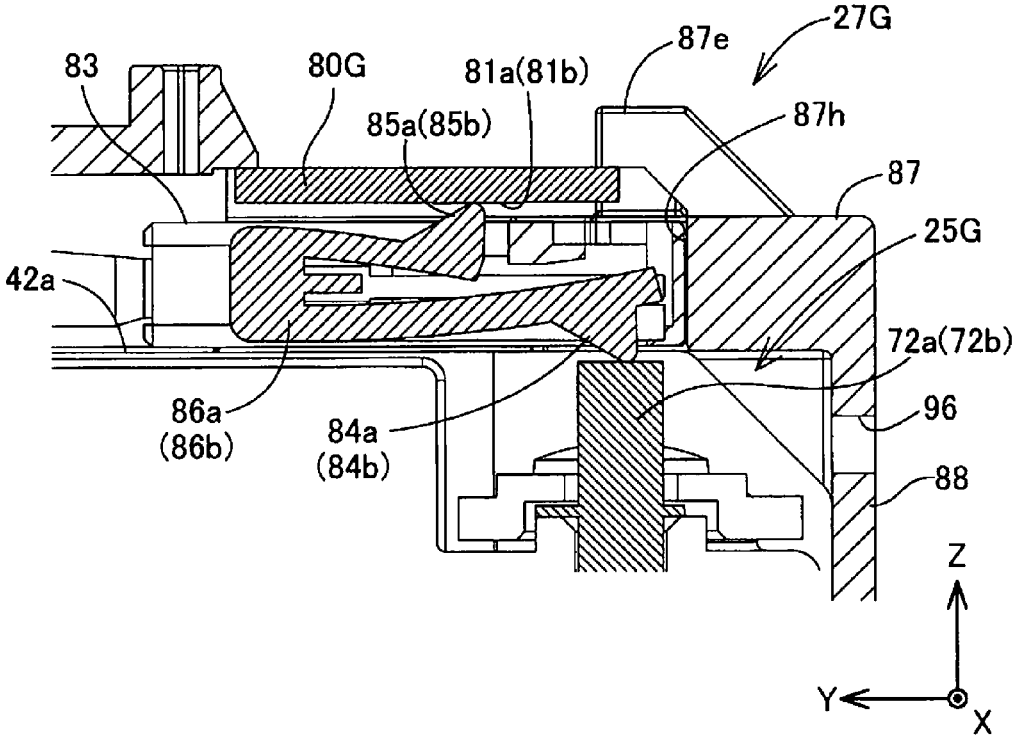
FIG. 26 is a schematic cross-sectional diagram of the tank unit in the seventh embodiment.

The configurations of a printer 10G and a tank unit 20G in a seventh embodiment of the invention will be described with reference to FIGS. 19 to 26. FIG. 19 is a schematic perspective diagram showing a portion of the configuration of the printer 10G of the seventh embodiment. In FIG. 19, a state in which the lid part 23 of the tank unit 20G of the seventh embodiment is closed is illustrated. FIG. 20 is a schematic perspective diagram showing the tank unit 20G of the seventh embodiment in a state in which the lid part 23 is opened. FIG. 21 a schematic perspective diagram showing the back face side of the tank unit 20G. FIG. 22 is a schematic side view of an ink tank 25G provided in the tank unit 20G of the seventh embodiment when viewed in a direction opposite to the direction of the arrow X. In FIG. 22, the internal structure of portions of the ink tank 25G is schematically is illustrated with broken lines. In FIG. 22, a state in which a substrate part 800 in the seventh embodiment is connected to ink tank 25G is illustrated. FIG. 23 is a schematic perspective diagram showing a state in which a circuit unit 27G is attached to the ink tank 25G, and corresponds to a diagram in which a casing part 21G has been removed from FIG. 21. FIG. 24 is a schematic exploded perspective diagram showing a state in which the pair of electrode pins 70*a* and 70*b* are separated from the ink tank 25G of the seventh embodiment and the circuit unit 27G of the seventh embodiment is disassembled. FIG. 25 is a schematic rear view showing a portion of the back face of the tank unit 20G. FIG. 26 is a schematic cross-sectional diagram of the tank unit 20G in a cross section taken along A-A shown in FIG. 25. In FIGS. 19 to 26, illustration of the tubes 26 and the cable wiring 28 are omitted for the sake of convenience.

The printer 10G of the seventh embodiment is substantially the same as the printer 10 of the first embodiment (FIG. 1) except that the tank unit 20G of the seventh embodiment is provided. The configuration of the tank unit 20G of the seventh embodiment is the same as the configuration of the tank unit 20E of the fifth embodiment except for the points described below. In the following description and reference drawings, the same reference signs as those used in the above embodiments are used for constituent elements that are the same as or correspond to the constituent elements described in the above embodiments.

The casing part 21G of the tank unit 20G of the seventh embodiment is constituted as a hollow box body made of resin (FIGS. 19 to 21). In the tank unit 20G of the seventh embodiment, a plurality of the ink tanks 25G are stored in the internal space 21*s* of the casing part 21G in a state of being arranged in a line in the direction of the arrow X. The plurality of ink tanks 25G includes two types of ink tanks having different ink capacities, that is, ink tanks 25Ga and 25Gb. The tank unit 20G stores three first ink tanks 25Ga and one second ink tank 25Gb. The second ink tank 25Gb has substantially the same configuration as that of the first ink tank 25Ga except that the second ink tank 25Gb has a width in the direction of the arrow X larger than that of the first ink tank 25Ga and thereby has an ink capacity larger than that of the first ink tank 25Ga. The ink tanks 25Ga and 25Gb will be described below as the ink tank 25G without differentiating between these two types of ink tanks unless particularly stated otherwise.

On the back face of the casing part 21G, the back face opening 93 is formed by the entirety of the back face side (of the casing part 21G) being open (FIG. 21). In the tank unit 20G, the fourth face part 44 sides of the ink tanks 25G are exposed from the back face opening 93. A plurality of engaging claw parts 22*c* and a plurality of screw fastening parts 22*s* are provided as the coupling part 22 on the back face of the casing part 21G. The engaging claw parts 22*c* protrude in the direction of the arrow Y on the lower side of the back face opening 93. The engaging claw parts 22*c* engage with the engagement holes (not illustrated) provided on the casing part 31 of the printing part 30 (FIG. 19). The screw fastening parts 22*s* protrude in the direction of the arrow Y on the upper and lower sides of the back face opening 93 (FIG. 21). The casing part 21G is screwed to the side face of the casing part 31 (FIG. 19) using a screw (not illustrated) that is inserted from the front face side into the screw fastening parts 22*s*.

A window part 29 is provided in a wall part of the casing part 21G of the tank unit 20G on the front face side that faces the third face parts 43 of the ink tanks 25G (FIGS. 19 and 20). A user can visually recognize, via the window part 29, the position of the liquid surface of the ink IN stored in the ink tanks 25G. In the tank unit 20G, when the lid part 23 of the casing part 21G is opened, the ink injection part 63 of each of the ink tanks 25G is exposed to the outside (FIG. 20). The user can replenish the ink tanks 25G with the ink IN by removing the cap member 65 from the ink injection part 63.

The ink tank 25G (FIG. 22) has, on the second face part 42, three upper face parts 42*a* to 42*c* having different height positions. The first upper face part 42*a* is at the highest position and is positioned between the second upper face part 42*b* and the third upper face part 42*c* in the front-back direction. The second upper face part 42*b* is positioned on the third face part 43 side, and the third upper face part 42*c* is positioned on the fourth face part 44 side. The third upper face part 42*c* is at a position higher than the second upper face part 42*b*. The ink injection part 63 is provided in the second upper face part 42*b*.

The pair of electrode pins 70*a* and 70*b* is attached to the third upper face part 42*c* in the following manner. A first cylindrical part 68*a* and a second cylindrical part 68*b* are provided in the third upper face part 42*c* so as to protrude upward (FIG. 24). The first cylindrical part 68*a* and the second cylindrical part 68*b* are arranged adjacent to each other in the direction of the arrow X. The first electrode pin 70*a* is inserted into a through hole of the first cylindrical part 68*a*, and the second electrode pin 70*b* is inserted into a through hole of the second cylindrical part 68*b*. The back ends 72*a* and 72*b* of the electrode pins 70*a* and 70*b* are positioned at positions that are higher than the upper end 63*t* of the ink injection part 63 and are lower than the first upper face part 42*a* (FIG. 22).

In the ink tank 25G (FIG. 22), the atmospheric air introduction part 51 is formed below the upper face parts 42*a* to 42*c* over the substantially entire region in the direction of the arrow Y. In addition, the atmospheric air introduction part 51 extends on the fourth face part 44 side of the ink container 50 to a connection section 61*c* with the ink supply part 61. Note that the atmospheric air introduction part 51 below the second upper face part 42*b* and the third upper face part 42*c* is positioned on the sixth face part 46 side relative to the arrangement regions of the through hole 64 of the ink injection part 63 and the pair of electrode pins 70*a* and 70*b* so as to avoid interference with them.

Here, the level difference face 42*d* directed in a direction opposite to the direction of the arrow Y is formed between the first upper face part 42*a* and the third upper face part 42*c* (FIG. 22). In the level difference face 42*d*, the atmospheric air intake part 55 similar to that described in the fourth embodiment is provided so as to protrude in a direction opposite to the direction of the arrow Y (FIG. 24). The atmospheric air intake part 55 is positioned on the right side of the back ends 72*a* and 72*b* of the electrode pins 70*a* and 70*b* when viewed in the direction of the arrow Y. In addition, the atmospheric air intake part 55 is positioned above the upper end 63*t* of the ink injection part 63 when viewed in the direction of the arrow Y, similarly to the back ends 72*a* and 72*b* of the electrode pins 70*a* and 70*b*.

In this manner, in the ink tank 25D, the atmospheric air intake part 55 and the back ends 72*a* and 72*b* of the electrode pins 70*a* and 70*b* are closely arranged in an upper region on back face side. Accordingly, accessibility to the atmospheric air intake part 55 and the back ends 72*a* and 72*b* of the electrode pins 70*a* and 70*b* is enhanced, and the ability to perform testing and maintenance of the ink tank 25G in the tank unit 20G is enhanced.

In the tank unit 20G, the single circuit unit 27G that is electrically connected to the ink tanks 25G is arranged in an upper portion of the fourth face part 44 side of the ink tanks 25G (FIGS. 21, and 23). The circuit unit 27G includes the substrate part 80G, a plurality of connecter units 83, and a supporting member 87 (FIG. 24).

In the tank unit 200, the substrate part 80G extends in the direction of the arrow X so as to be capable of electrical connection to the electrode pins 70*a* and 70*b* of each of the ink tanks 25G (FIGS. 23 and 24). A plurality of pairs of the substrate terminals 81*a* and 81*b* are provided on a substrate surface of the lower side of the substrate part 80G, the plurality of pairs of the substrate terminals 81*a* and 81*b* being provided so as to correspond to the pair of electrode pins 70*a* and 70*b* of each of the ink tanks 25G (FIG. 22). On a substrate surface of the upper side of the substrate part 800, the single cable connection part 82 is provided at a position toward the end (of the substrate surface) on the side in a direction opposite to the direction of the arrow X (FIGS. 23 and 24). The substrate terminals 81*a* and 81*b* and the cable connection part 82 are connected via a wiring pattern (not illustrated) formed on the substrate part 80G.

Below the substrate part 80G, each of the connecter units 83 is arranged on one corresponding ink tank, among a plurality of the ink tanks 25G, so as to be able to mediate electrical connection between the substrate part 80G and the ink tanks 25G (FIG. 24). The connecter unit 83 is substantially plate-shaped, and has a pair of first terminals 84*a* and 84*b* and a pair of second terminals 85*a* and 85*b* (FIGS. 24 and 26). The pair of second terminals 85*a* and 85*b* come into electrical contact with the pair of substrate terminals 81*a* and 81*b*. The pair of the first terminals 84*a* and 84*b* come into electrical contact with the back ends 72*a* and 72*b* of the electrode pins 70*a* and 70*b*.

The first terminal 84*a* and the second terminal 85*a* are coupled via a first plate-like conductive part 86*a* (FIG. 26). In addition, the first terminal 84*b* and the second terminal 85*b* are coupled via a second plate-like conductive part 86*b*. The plate-like conductive parts 86*a* and 86*b* are curved in a leaf spring shape and thus are constituted so as to be elastically deformable in the direction of the thickness of the connecter unit 83. The first terminals 84*a* and 84*b* and the second terminals 85*a* and 85*b* are biased in the direction of the thickness of the connecter units 83 by the plate-like conductive parts 86*a* and 86*b*. Accordingly, in the connecter units 83, the ability of the substrate terminals 81*a* and 81*b* to come into contact with the back ends 72*a* and 72*b* of the electrode pins 70*a* and 70*b* is enhanced. In addition, flexural deformation of the substrate part 80G due to pressing force exerted by the electrode pins 70*a* and 70*b* is restrained.

The supporting member 87 is a plate-like member extending in the direction of the arrow X, and is installed above the ink tanks 25G. The length of the supporting member 87 in the direction of the arrow X is larger than the length of the substrate part 80G in the direction of the arrow X. The supporting member 87 is made of synthetic resin such as nylon or polypropylene. The substrate part 80G and a plurality of the connecter units 83 are fixed and supported on the supporting member 87. An engaging claw 87*e* for regulating a movement of the substrate part 80G by engaging with the outer edge of the substrate part 80G and a fitting hole 87*h* that the connecter units 83 fits are provided on the supporting member 87.

The supporting member 87 is fixed, at screw fastening parts 87*s* provided at the two ends of the supporting member 87 in the direction of the arrow X, to the casing part 21G by being screwed to the wall part of an upper portion of the casing part 21G (FIGS. 21, 24 and 25). In the tank unit 20G, flexural deformation of the substrate part 80G and the like is restrained by the supporting member 87. In addition, a plurality of the connecter units 83 can be connected to the electrode pins 70*a* and 70*b* of the corresponding ink tank 25G at a time by the supporting member 87, and thereby the ability to connect to the circuit unit 27G is enhanced.

The supporting member 87 is fixed to the first upper face part 42*a* of the ink tanks 25G using a screw 89 (FIG. 23). Accordingly, the ink tanks 25G are fixed to the casing part 21G via the supporting member 87.

A plurality of protection wall parts 88 are formed at the end of back face side of the supporting member 87 (FIGS. 23 and 24). The protection wall parts 88 are each formed so as to extend downward in the vertical direction at a position facing one of the ink tanks 25G. The protection wall parts 88 are arranged at positions overlapping the back ends 72*a* and 72*b* of the electrode pins 70*a* and 70*b* of the ink tank 25G when the tank unit 20G is viewed in the direction of the arrow Y (FIGS. 25 and 26). The protection wall parts 88 are positioned between the printing part 30 and the back ends 72*a* and 72*b* of the electrode pins 70*a* and 70*b* when the tank unit 20G is coupled to the printing part 30. In the tank unit 20G, a connection section between the circuit unit 27G and the electrode pins 70*a* and 70*b* is protected against intrusion of a foreign material and the like by the protection wall parts 88.

A through window 96 is provided in each of the protection wall parts 88 (FIGS. 25 and 26). The through windows 96 are formed at positions overlapping portions of the back ends 72*a* and 72*b* of the electrode pins 70*a* and 70*b* when the through windows 96 are viewed in the direction of the arrow Y that is the opening direction thereof (FIG. 25). In the tank unit 20G, portions of the back ends 72*a* and 72*b* of the electrode pins 70*a* and 70*b* are exposed to the outside via the back face opening 93 of the casing part 21G and the through windows 96 of the supporting member 87. In the fifth embodiment, the back face opening 93 and the through window 96 each correspond to a subordinate concept of the opening in the invention.

According to the tank unit 20G, the electrical conductivity test for the electrode pins 70*a* and 70*b* of each of the ink tanks 25G can be performed in a simple manner via the through window 96 while the ink tanks 25G are fixed in the casing part 21G. In addition, with the tank unit 20G, the electrical conductivity test can be performed using the test apparatus 200 described in the first embodiment (FIGS. 5 and 6).

In addition, in the tank unit 20G, contact sections between the connecter units 83 and the electrode pins 70*a* and 70*b* are positioned outside of the through window 96 when viewed in the opening direction of the through window 96. That is, among sections in the back ends 72*a* and 72*b* of the electrode pins 70*a* and 70*b*, sections other than sections that are in contact with the first terminals 84*a* and 84*b* of the connecter units 83 are positioned in the through window 96. Accordingly, the contact section between the connecter units 83 and the electrode pins 70*a* and 70*b* is unlikely to be exposed, and thereby the ability to protect the contact section is enhanced.

When the tank unit 20G is viewed in the direction of the arrow Y, the atmospheric air intake part 55 of each of the ink tanks 25G is positioned at a position spaced apart from the protection wall parts 88, and is positioned at a position that does not overlap the protection wall parts 88 (FIG. 25). Therefore, according to the tank unit 20G, the air tightness test for the ink tanks 25G can be performed in a simple manner using the atmospheric air intake part 55 exposed from the back face opening 93 in a state in which coupling with the printing part 30 is released. In addition, with the tank unit 20G, the back ends 72*a* and 72*b* of the electrode pins 70*a* and 70*b* and the atmospheric air intake part 55 are arranged in the direction of the arrow X when viewed in the direction of the arrow Y. In addition, the through window 96 and the atmospheric air intake part 55 are arranged in the direction of the arrow X. Therefore, the electrical conductivity test and the air tightness test for the ink tanks 25G can be performed at the same time, by using the test apparatus 200D (FIGS. 13 and 14) described in the fourth embodiment.

As described above, according to the tank unit 20G of the seventh embodiment, the electrical conductivity test for the electrode pins 70*a* and 70*b* of each of the ink tanks 25G, and the air tightness tests for the ink tanks 25G can be performed in a simple manner. Additionally, according to the tank unit 20G and the printer 10G of the seventh embodiment, it is possible to exhibit various actions and effects similar to those described in the above embodiments.

H. Eighth Embodiment

Figure 27:
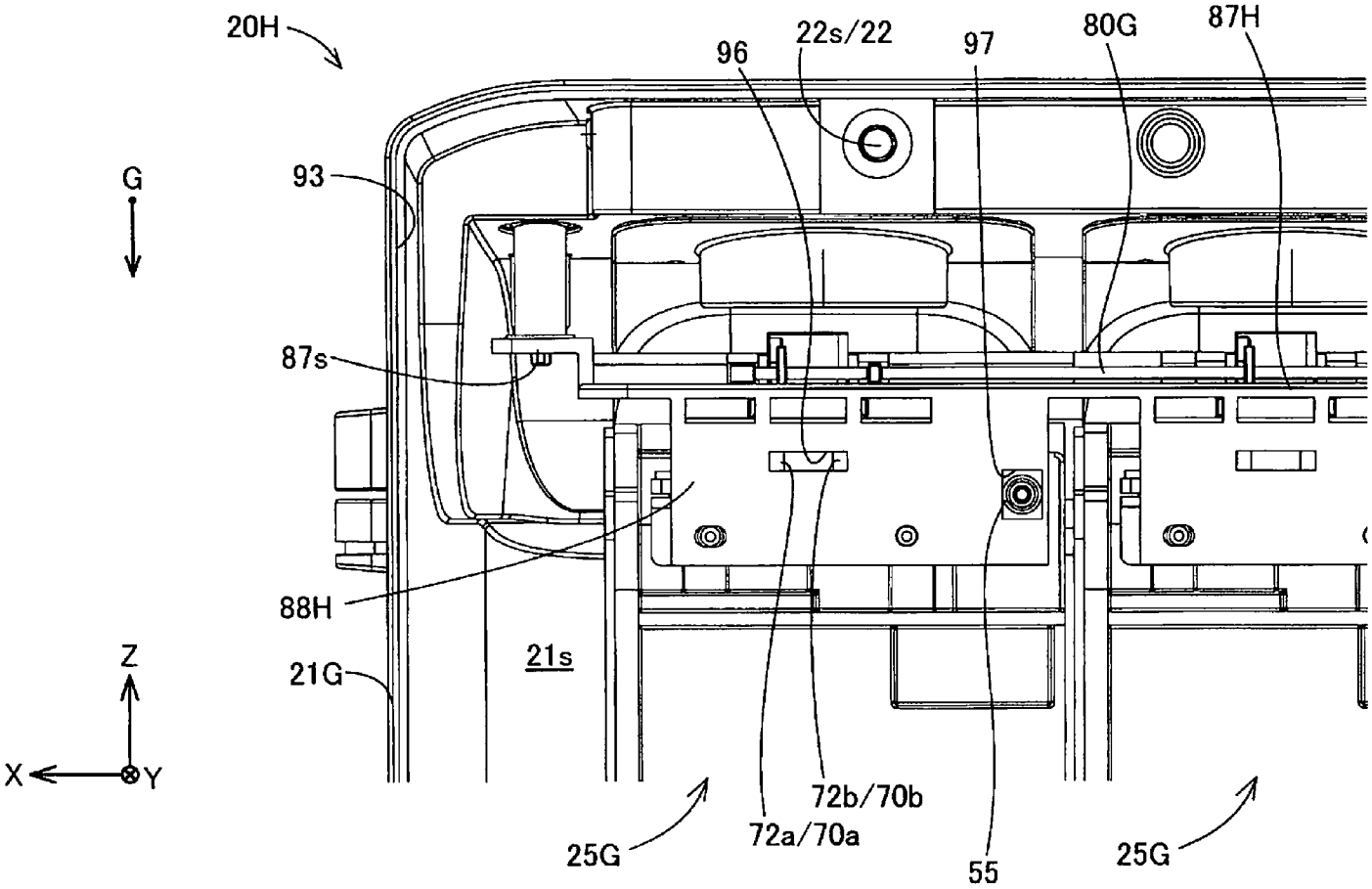
FIG. 27 is a schematic rear view showing a portion of a back face of a tank unit in an eighth embodiment.

FIG. 27 is a schematic rear view showing a portion of the back face of a tank unit 20H in an eighth embodiment of the invention. The configuration of the tank unit 20H of the eighth embodiment is substantially the same as that of the tank unit 20G of the seventh embodiment except that the configuration of a protection wall part 88H of a supporting member 87H is different. A printer of the eighth embodiment is substantially the same as that of the printer 10G of the seventh embodiment (FIG. 19) except that the tank unit 20H is provided. In the following description and reference drawings, the same reference signs as those used in the above seventh embodiment are used for constituent elements that are the same as or correspond to the constituent elements described in the above seventh embodiment.

In the tank unit 20H of the eighth embodiment, the width of the protection wall part 88H in the direction of the arrow X is larger than the width of the protection wall part 88 of the seventh embodiment. In addition to the through window 96 (hereinafter, referred to as "the first through window 96") from which the back ends 72*a* and 72*b* of the electrode pins 70*a* and 70*b* are exposed, a second through window 97 from which the atmospheric air intake part 55 is exposed is provided in the protection wall part 88H.

According to the tank unit 20H of the eighth embodiment, similarly to the tank unit 20G of the seventh embodiment, the electrical conductivity test for the electrode pins 70*a* and 70*b* of each of the ink tanks 25G and the air tightness tests for the ink tanks 25G can be performed in a simple manner. In addition, according to the tank unit 20H of the eighth embodiment, the larger the area of the protection wall part 88 is, the more the ability to protect the ink tanks 25G is enhanced. Additionally, according to the tank unit 20H of the seventh embodiment and a printer that is provided therewith, it is possible to exhibit various actions and effects similar to those described in the above embodiments.

Figure 28:
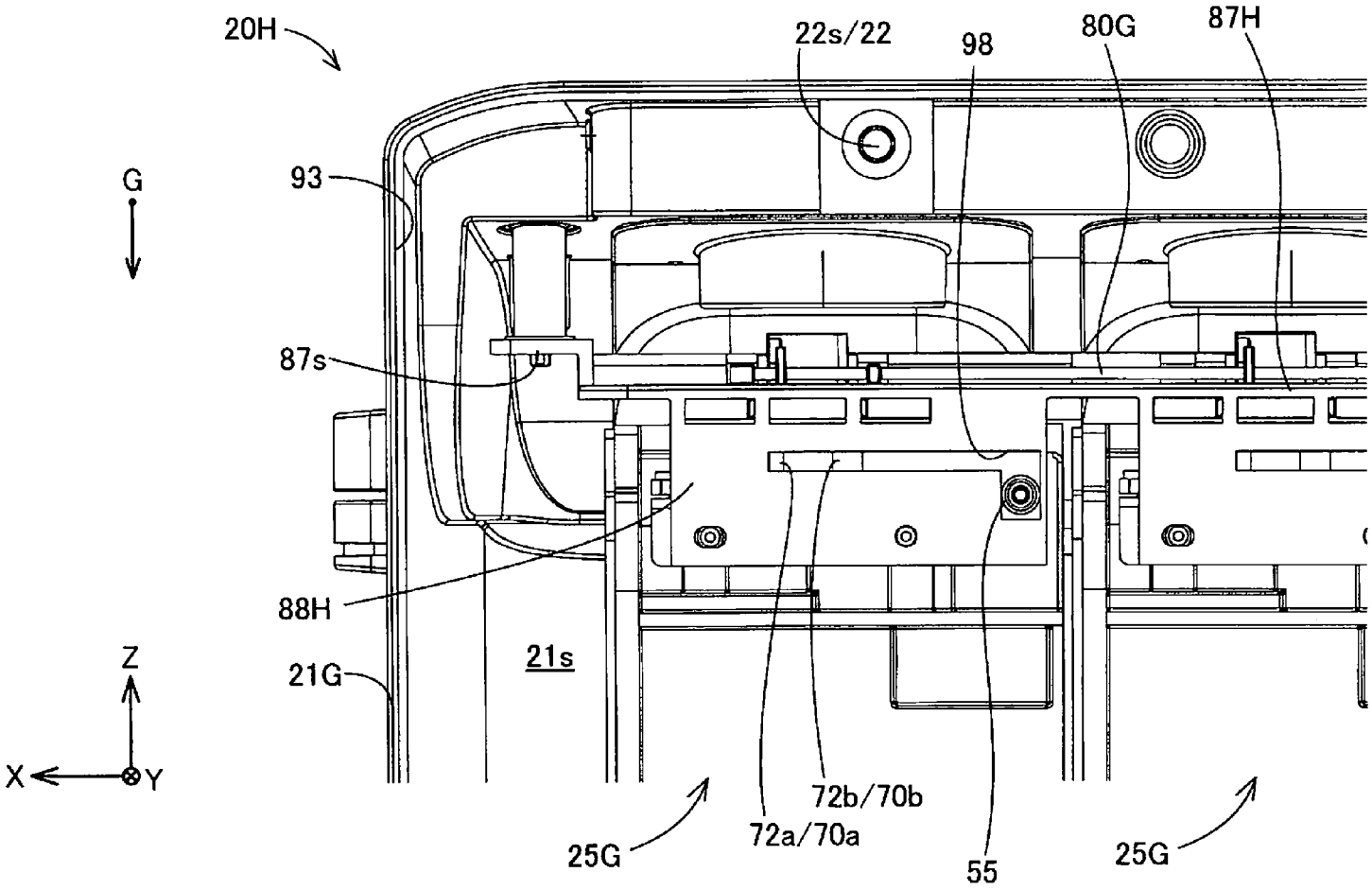
FIG. 28 is schematic diagram showing another configuration example of the tank unit in the eighth embodiment.
Figure 29:
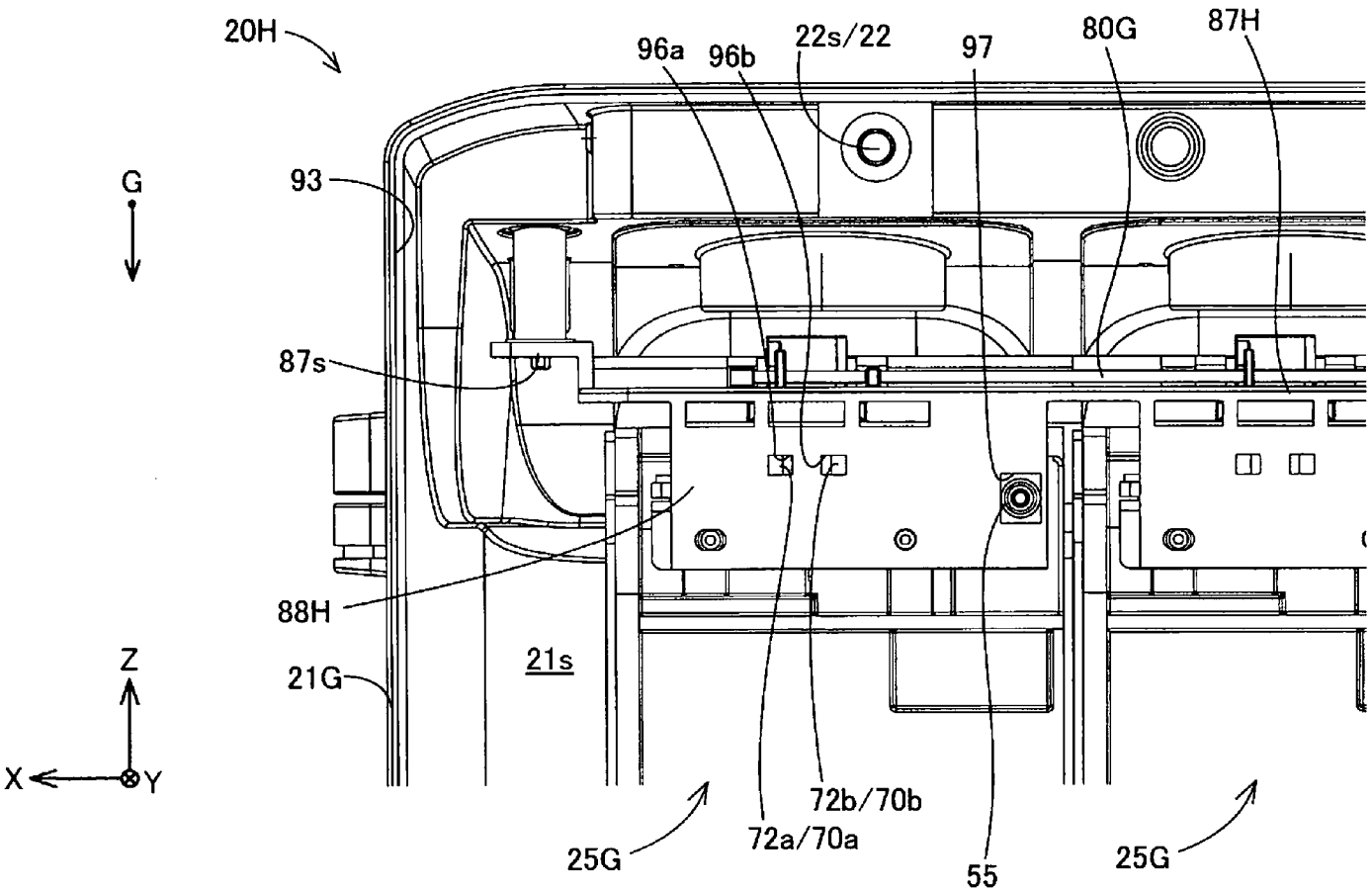
FIG. 29 is a schematic diagram showing another configuration example of the tank unit in the eighth embodiment.

Another configuration example of the tank unit 20H of the eighth embodiment will be described with reference to FIGS. 28 and 29. In FIGS. 28 and 29, a portion of the back face of the tank unit 20H is illustrated in the same manner as FIG. 27. A through window 98 created by integrating the first through window 96 and the second through window 97 may be provided in the protection wall part 88H (FIG. 28). In addition, instead of the first through window 96, a through window 96*a* formed at a position corresponding to the back end 72*a* of the first electrode pin 70*a* and a through window 96*b* formed at a position corresponding to the back end 72*b* of the second electrode pin 70*b* may be provided in the protection wall part 88H (FIG. 29). With these configurations, it is also possible to exhibit various actions and effects similar to those described above.

I. MODIFIED EXAMPLES

I1. Modified Example 1

The positions of the tank units 20A to 20H of the above embodiments relative to the printing part 30 are fixed in a state where the tank units 20A to 20H are coupled to the printing part 30 by the coupling part 22. However, the tank unit 20A to 20H may be constituted so as to be displaceable relative to the printing part 30, even in a state where the tank units 20A to 20H are coupled to the printing part 30 by the coupling part 22. For example, the tank units 20A to 20H may be rotatably coupled to the printing part 30 by the coupling part 22 constituted by a hinge mechanism. It is sufficient that the tank units 20A to 20H are constituted such that openings for exposing the electrode pins 70*a* and 70*b* face the printing part 30 when the tank units 20A to 20H are coupled to the printing part 30.

I2. Modified Example 2

The tank unit 20A to 20H of the above embodiments have the circuit units 27 and 27G for electrically connecting the ink tanks 25A, 25C, 25D, and 25G to the printing part 30. However, the circuit unit 27 and 27G may be omitted. The back ends 72*a* and 72*b* of the electrode pins 70*a* and 70*b* in each of the ink tanks 25A, 25C, 25D, and 25G may be connected directly to a conductive wire or the like without interposing the circuit units 27 and 27G.

I3. Modified Example 3

In the above embodiments, the ink tanks 25A, 25C, 25D, and 25G include the pair of electrode pins 70*a* and 70*b* that are used for detection of ink. However, the ink tanks 25A, 25C, 25D, and 25G do not need to include the pair of electrode pins 70*a* and 70*b*. The ink tanks 25A, 25C, 25D, and 25G may include, instead of the pair of electrode pins 70*a* and 70*b*, a terminal part for communicating, with the control unit 35, an electrical signal indicating information regarding ink, for example. It is sufficient that the ink tanks 25A, 25C, 25D, and 25G include a terminal part used for exchanging an electrical signal of some kind with an external object.

I4. Modified Example 4

In the above embodiments, at least portions of the terminal parts of the ink tanks 25A, 25C, 25D, and 25G are positioned in the regions in the openings provided in the casing part 21A to 21E and 21G and the supporting members 87 and 87H when viewed in opening directions of those openings. However, the terminal parts of the ink tanks 25A, 25C, 25D and 25G may be at positions sifted by a few millimeters from the regions in the openings, for example. It is sufficient that the terminal parts of the ink tanks 25A, 25C, 25D, and 25G are at positions that allow those terminal parts to be visually recognized and touched directly from the outside via the openings.

I5. Modified Example 5

Each of the tank units 20A to 20H of the above embodiments includes a plurality of ink tanks. However, a tank unit may include one ink tank only. In addition, the tank units 20G and 20H of the above seventh and eighth embodiments have three first ink tanks 25Ga having a smaller ink capacity and one second ink tank 25Gb having a larger ink capacity. However, the tank units 20G and 20H may have one first ink tank 25Ga only and a plurality of second ink tanks 25Gb. The tank units 20G and 20H may include three or more types of ink tanks having different ink capacities.

I6. Modified Example 6

The configurations of the above embodiments can be appropriately combined. For example, the supporting members 87 and 87H provided in the tank units 20G and 20H of the above seventh and eighth embodiments may be applied to tank units of embodiments other than the above seventh and the eighth embodiments. In addition, the configurations of the sealing members 94, 94*a* and 94*b* of the above sixth embodiment may be applied to the through window 96 of the supporting members 87 and 87H of the above seventh and eighth embodiments or the like. Additionally, the configuration of the electrode pad parts 76*a* and 76*b* in the third embodiment being exposed from the through windows 92 may be applied to the tank units of the fourth, fifth, sixth, seventh, and the eighth embodiments.

I7. Modified Example 7

The configurations of the tank units in the above embodiments may be applied to a tank unit that can supply a liquid other than ink to a liquid supply apparatus, and the configurations of the printers of the above embodiments may be applied to a liquid jetting system for jetting a liquid other than ink. For example, the configuration of the printers of the above embodiments may be applied to a tank unit that can supply a liquid detergent or a detergent jetting system for jetting a liquid detergent.

The invention is not limited to the above embodiments, examples, and modifications, and can be achieved in various configurations without departing from the gist of the invention. For example, the technical features in the embodiments, examples, and modifications corresponding to the technical features in the modes can be replaced or combined as appropriate in order to solve a part of or the entire problem described above, or in order to achieve some or all of the aforementioned effects. A technical feature that is not described as essential in the specification can be deleted as appropriate.

The entire disclosure of Japanese Patent Application No. 2015-049557, filed on Mar. 12, 2015 is expressly incorporated herein by reference.

What is claimed is:

1. A tank unit configured to supply a liquid to a liquid jetting apparatus, the tank unit comprising:

a tank that includes a liquid container configured to store the liquid and an electrode part extending from an inside of the liquid container to an outside of the tank, the electrode part being configured to electrically connect to the liquid jetting apparatus; and an exterior part storing the tank and configured to be coupled to the liquid jetting apparatus, the exterior part having one or more openings that expose at least a portion of the electrode part to an outside of the exterior part, and the exterior part being configured to be coupled to the liquid jetting apparatus in a posture in which the one or more openings face the liquid jetting apparatus.

2. The tank unit according to claim 1, wherein at least a portion of the electrode part is positioned in the one or more openings when the one or more openings are viewed in an opening direction.

3. The tank unit according to claim 1, wherein the electrode portion is configured to detect the liquid stored in the liquid container, and the electrode portion includes a terminal part that is disposed at the outside of the tank.

4. The tank unit according to claim 1, wherein the tank further includes an atmospheric air intake part configured to introduce atmospheric air into the liquid container, and the atmospheric air intake part is exposed to the outside of the exterior part from the one or more openings and is open toward the one or more openings.

5. The tank unit according claim 4, wherein the tank further includes a liquid injection part configured to inject the liquid from outside into the liquid container, and at least a portion of the electrode part exposed from the one or more openings and the atmospheric air intake part are positioned at positions that are above the liquid container and are closer to the liquid jetting apparatus than the liquid injection part when the exterior part is coupled to the liquid jetting apparatus.

6. The tank unit according to claim 4, wherein the tank further includes a liquid injection part configured to inject the liquid from outside to the liquid container, and at least a portion of the electrode part exposed from the one or more openings and the atmospheric air intake part are positioned at positions that are higher than the liquid injection part and are closer to the liquid jetting apparatus than the liquid injection part when the exterior part is coupled to the liquid jetting apparatus.

7. The tank unit according to claim 1, further comprising a sealing member configured to seal the one or more openings.

8. The tank unit according to claim 1, wherein the tank is a first tank having a first liquid container that is the liquid container configured to store a first liquid and a first electrode part that is the electrode part, the tank unit further includes a second tank having a second liquid container configured to store a second liquid and a second electrode part extending from an inside of the second liquid container to an outside of the second tank, the second electrode part being configured to electrically connect to the liquid jetting apparatus, and at least a portion of the second electrode part is exposed to the outside of the exterior part via the one or more openings.

9. The tank unit according to claim 8, wherein the first tank includes a first atmospheric air intake part configured to introduce atmospheric air into the first liquid container, the second tank includes a second atmospheric air intake part configured to introduce atmospheric air into the second liquid container, and the first atmospheric air intake part and the second atmospheric air intake part are exposed to the outside of the exterior part from the one or more openings and are open toward the openings.

10. The tank unit according to claim 1, wherein the tank is a first tank having a first liquid container that is the liquid container configured to store a first liquid, and a first electrode part that is the electrode part, the tank unit further includes a second tank having a second liquid container configured to store a second liquid and a second electrode part extending from an inside of the second liquid container to an outside of the second tank, the second electrode part being configured to electrically connect to the liquid jetting apparatus, and the one or more openings in the exterior part include a first opening that exposes at least a portion of the first electrode part to the outside of the exterior part and a second opening that exposes at least a portion of the second electrode part to the outside of the exterior part.

11. The tank unit according to claim 10, wherein the first tank includes the first atmospheric air intake part configured to introduce atmospheric air into the first liquid container, the second tank includes the second atmospheric air intake part configured to introduce atmospheric air into the second liquid container, and the first atmospheric air intake part is exposed to the outside of the exterior part from the first opening and is open toward the first opening, and the second atmospheric air intake part is exposed to the outside of the exterior part from the second opening and is open toward the second opening.

12. A liquid jetting system comprising:

the tank unit according to claim 1;

a liquid jetting apparatus including a liquid jetting head; and a tube that allows a liquid to flow between the tank unit and the liquid jetting head.

13. A tank unit configured to supply a liquid to a liquid jetting apparatus, the tank unit comprising:

a tank that includes a liquid container configured to store the liquid and an electrode part extending from an inside of the liquid container to an outside of the tank, the electrode part being configured to electrically connect to the liquid jetting apparatus;

an exterior part storing the tank and configured to be coupled to the liquid jetting apparatus; and a supporting member that fixes the tank to the exterior part, in the exterior part, the supporting member having one or more openings that are positioned between the electrode part and the liquid jetting apparatus when the exterior part is coupled to the liquid jetting apparatus, and at least a portion of the electrode part being exposed to an outside of the supporting member via the one or more openings when the exterior part is not coupled to the liquid jetting apparatus.

14. The tank unit according to claim 13, wherein the tank is a first tank having a first liquid container that is the liquid container configured to store a first liquid, and a first electrode part that is the electrode part, the tank unit further includes a second tank that has a second liquid container configured to store a second liquid and a second electrode part extending from an inside of the second liquid container to an outside of the second tank, the second electrode part being configured to electrically connect to the liquid jetting apparatus, the supporting member fixes the first tank and the second tank to the exterior part, and the one or more openings in the supporting member include a first opening that exposes at least a portion of the first electrode part to the outside of the supporting member and a second opening that exposes at least a portion of the second electrode part to the outside of the supporting member.

15. A tank unit configured to supply a liquid to a liquid jetting apparatus, the tank unit comprising:

a tank that includes a liquid container configured to store the liquid and a terminal part configured to electrically connect to the liquid jetting apparatus;

an exterior part storing the tank; and a supporting member that fixes the tank to the exterior part, in the exterior part, wherein the exterior part includes an opening that exposes at least a portion of the supporting member and at least a portion of the tank to the outside, and an opening that exposes at least a portion of the terminal part to the outside is provided in a section in the supporting member that is exposed from the opening in the exterior part.

* * * * *